US009726413B2

(12) United States Patent
Seo et al.

(10) Patent No.: US 9,726,413 B2
(45) Date of Patent: Aug. 8, 2017

(54) REFRIGERATOR AND METHOD FOR CONTROLLING THE SAME

(71) Applicant: LG ELECTRONICS INC., Seoul (KR)

(72) Inventors: Woonkyu Seo, Seoul (KR); Jaeyoung Kim, Seoul (KR); Daesung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/673,950

(22) Filed: Mar. 31, 2015

(65) Prior Publication Data

US 2015/0276293 A1 Oct. 1, 2015

(30) Foreign Application Priority Data

Mar. 31, 2014 (KR) ..... 10-2014-0037716

(51) Int. Cl.
*F25D 11/00* (2006.01)
*F25C 5/00* (2006.01)
*F25D 23/12* (2006.01)

(52) U.S. Cl.
CPC ..... *F25C 5/005* (2013.01); *F25D 23/126* (2013.01); *F25D 2400/36* (2013.01)

(58) Field of Classification Search
CPC ..... F25C 2400/04; F25C 2400/14; F25C 2600/02; F25C 2600/04; F25C 2700/02; F25C 2700/04; F25C 5/005; F25C 5/182; F25D 11/00; F25D 23/028; F25D 23/126
See application file for complete search history.

(56) References Cited

U.S. PATENT DOCUMENTS 9,078,937 B2 * 7/2015 Beilfuss ..... F25D 3/00
2008/0178628 A1 * 7/2008 Jang ..... F25C 1/24 62/389
2009/0306827 A1 * 12/2009 Kim ..... F24F 11/0086 700/275
2010/0319389 A1 * 12/2010 Yang ..... F25D 23/126 62/389
2011/0259033 A1 * 10/2011 Froehlich ..... F25C 5/005 62/344

(Continued)

FOREIGN PATENT DOCUMENTS

KR 20090107368 A * 10/2009 ..... F25C 5/005

*Primary Examiner* — Frederick C Nicolas
*Assistant Examiner* — Bob Zadeh
(74) *Attorney, Agent, or Firm* — Fish & Richardson P.C.

(57) ABSTRACT

A refrigerator includes a door, a dispenser in the door, a water nozzle and an ice nozzle on the dispenser, the ice nozzle being arranged in a line with the water nozzle, and a single manipulation member under the water nozzle and the ice nozzle that is manipulated in a same direction as the arranged direction of the water nozzle and the ice nozzle, the manipulation member allowing selection between dispensing of water and ice. The refrigerator also includes a detection member on the dispenser for recognizing a manipulation of the manipulation member, a control unit for controlling a valve and a motor to dispense either the water or ice based on an input of the detection member, and a display unit on the dispenser for displaying a selected state of the water or ice according to a manipulated state of the manipulation member.

22 Claims, 20 Drawing Sheets

(56) References Cited

U.S. PATENT DOCUMENTS

2013/0312872 A1* 11/2013 Tobbe ..... B67D 1/1236
141/83
2015/0276293 A1* 10/2015 Seo ..... F25D 23/126
222/1

* cited by examiner

REFRIGERATOR AND METHOD FOR CONTROLLING THE SAME

CROSS-REFERENCE TO RELATED APPLICATIONS

The present application claims priority under 35 U.S.C. 119 and 35 U.S.C. 365 to Korean Patent Application No. 10-2014-0037716 (filed on Mar. 31, 2014), which is hereby incorporated by reference in its entirety.

FIELD

The present disclosure relates to a refrigerator and a method for controlling the same.

BACKGROUND

In general, refrigerators are home appliances for storing foods at a low temperature in a storage space thereof that is covered by a door. For this, refrigerators cool the inside of the storage space by using cool air generated by being heat-exchanged with a refrigerant circulated into a refrigeration cycle to store foods in an optimum state.

In recent years, refrigerators having various convenience equipment have been brought to the market. A dispenser for dispensing water or ice from the outside in a state where a refrigerator is closed is one representative example of such convenience equipment.

In general, such dispenser is provided on a front surface of a refrigerator door to dispense water or ice by manipulating a lever. For this, the dispenser can include a water nozzle for dispensing water and an ice nozzle for ice. The lever can be disposed under each of the water nozzle and the ice nozzle. Thus, the lever can be manipulated to dispense water or ice. Such lever can be manipulated after first using a separate button to select whether water or ice should be dispensed.

SUMMARY

According to one aspect, a refrigerator includes a main body, a storage space defined within the main body, a door configured to open and close at least a portion of the storage space, a dispenser provided in the door, a water nozzle disposed on the dispenser and configured to dispense water, an ice nozzle disposed on the dispenser and configured to dispense ice, the ice nozzle being arranged in a line with the water nozzle, a single manipulation member disposed under the water nozzle and the ice nozzle and configured to be manipulated in a same direction as the arranged direction of the water nozzle and the ice nozzle, the manipulation member being configured to enable selection between dispensing of water and dispensing of ice, a detection member disposed on the dispenser and configured to recognize manipulation of the manipulation member, a control unit configured to control a valve and a motor to thereby dispense either the water or ice based on an input of the detection member, and a display unit disposed on the dispenser and configured to display a selected state of the water or ice according to a manipulated state of the manipulation member.

Implementations of this aspect may include one or more of the following features. For example, the water nozzle and the ice nozzle may be arranged along a front to rear direction of the refrigerator. The manipulation member may be configured to, based on being manipulated, successively pass under corresponding outlets of the water nozzle and the ice nozzle. The refrigerator may include a plurality of multi-stage elastic members, wherein the manipulation member may be configured to push against the plurality of multi-stage elastic members so that the selection of water or ice is performed in stages. The plurality of elastic members may have elastic coefficients that are different from one another. The refrigerator may include a dispenser case that defines a recessed shape of the dispenser, the manipulation member being configured to be inserted by passing through the dispenser case. The detection member may include a plurality of detection members that are disposed inside the dispenser case and spaced apart from each other by a preset distance along the moving direction of the manipulation member.

Further according to this aspect, wherein a first manipulation region of the manipulation member that corresponds to the dispensing of water may be smaller than a second manipulation region of the manipulation member that corresponds to the dispensing of ice. The detection member may be configured to, based on determining that the ice dispensing manipulation has been performed, determine whether to dispense crushed ice or ice cubes according to a manipulated degree of the manipulation member. The control unit may be configured to, based on a dispensing selection signal of the water or ice being inputted from the detection member, control the dispensing of the water or ice after a preset time elapses. The display unit may include a display configured to display elapsing of the preset time. The display unit may be configured to display elapsing of the preset time in stages. The display unit may include a speaker configured to produce a sound configured to inform elapsing of the preset time. The control unit may be configured to cancel the dispensing manipulation signal of the water or ice based on the manipulation member returning to its original position before the preset time elapses. The display unit may be disposed on a front surface of a cover that is configured to cover the water nozzle and the ice nozzle.

According to another aspect, a refrigerator includes a main body, a storage space defined within the main body, a door configured to open and close at least a portion of the storage space, a dispenser provided in the door, a water nozzle disposed on the dispenser and configured to dispense water, an ice nozzle disposed on the dispenser and configured to dispense ice, a single manipulation member disposed under the water nozzle and the ice nozzle, the manipulation member being configured to be manipulated in a single continuous direction to manipulate dispensing one at a time of water and ice, a detection member disposed on the dispenser and configured to recognize manipulation of the manipulation member, and a control unit configured to control a valve and motor to thereby dispense the water or ice according to an input of the detection member.

Implementations of this aspect may include one or more of the following features. For example, the manipulation member may be configured to be manipulated to pass under outlets of the water nozzle and the ice nozzle. An outlet of the water nozzle may be positioned forward of an outlet of the ice nozzle. The manipulation member may include a guide that is configured to guide a movement of the manipulation member. One of the manipulation member or the water nozzle may include a stopper that is configured to make contact with the other of the manipulation member or the water nozzle to thereby restrict a movement of the manipulation member. The stopper may be formed of a rubber or a synthetic resin material, and the stopper may be disposed on a side of the manipulation member that faces the water nozzle and configured to correspond to a circumferential or contact position of the water nozzle. The detection member may be configured to, based on the manipulation member being disposed under an outlet of the water nozzle or the ice nozzle, cause the dispensing of the water or ice to be selected. The manipulation member may be configured to be inserted through a rear wall of the dispenser while passing under outlets of the water nozzle and the ice nozzle. The manipulation member may be shaft-coupled to a side of the dispenser and configured to rotate relative to the dispenser. The detection member may be disposed on a side of the dispenser and configured to detect a moving distance of the manipulation member, the detection member being configured to detect a dispensing selection of the water or ice based on the detected moving distance. The detection member may be disposed on a side of the dispenser and configured to detect the intensity of a pressure applied to the manipulation member, the detection member being configured to detect a dispensing selection of the water or ice based on the detected intensity. The detection member may be disposed on the manipulation member and configured to detect a number of times that the manipulation member is touched, the detection member being configured to detect a dispensing selection of the water or ice based on the detected number of touches. The control unit may be configured to control the valve and motor so that the valve and motor are driven based on a preset time elapsing after the selection of the manipulation is detected. The dispenser may include a display unit that is configured to display a selected state of the water or ice based on manipulation of the manipulation member and an elapsing state of the preset time. The manipulation member for dispensing the ice may be configured to be manipulated in stages to thereby enable corresponding selection and dispensing of ice cubes and crushed ice through the ice nozzle.

According to another aspect, a refrigerator includes a main body, a storage space defined within the main body, a door configured to open and close at least a portion of the storage space, a dispenser provided in the door, a water nozzle disposed on the dispenser and configured to dispense water, an ice nozzle disposed on the dispenser and configured to dispense ice, a single manipulation member disposed under the water nozzle and the ice nozzle, the manipulation member being configured to be continuously moved in a single direction in stages to thereby manipulate selecting and dispensing, one at a time, of the water and ice, a water detection member and an ice detection member that are disposed inside the dispenser along a moving path of the manipulation member, the water detection member and the ice detection member each being configured to recognize manipulation of the manipulation member, a control unit configured to control a valve and motor to thereby dispense the water or ice according to an input of the detection member, and a display unit disposed on the dispenser and configured to display the selected state of the water or ice according to the manipulation of the manipulation member. The manipulation member includes a manipulation part configured to be pushed by a cup or a hand of a user, and an extension part that extends from the manipulation part and is configured to be inserted into a case of the dispenser.

Implementations of this aspect may include one or more of the following features. For example, the detection members may be provided as switches that are arranged along a moving path of the extension part and spaced apart from each other by a predetermined distance, the detection members being configured to be successively contacted by the extension part. The detection members may be configured and arranged to contact one side of the extension part based on the manipulation part passing under an outlet of the water nozzle and an outlet of the ice nozzle. A shape of the extension part and a shape of a side of the dispenser in which the extension part is accommodated may match each other, and the dispenser may include a plurality of recess part configured to guide a multistage movement of the manipulation member, and a contact protrusion selectively accommodated into each of the plurality of recess parts. The dispenser may include a plurality of recess parts in which each of the detection members are respectively accommodated, the plurality of recess parts being located at positions corresponding to positions of the manipulation member for which the water and ice are correspondingly selected, and a contact protrusion protruding from the extension part, the contact protrusion being configured to be received by each of the plurality of recess parts according to the movement of the manipulation member. The water detection member may be disposed at a front side of the ice detection member.

Further according to this aspect, the ice detection member may include a crushed ice detection member and an ice cube detection member, and the crushed ice detection member and the ice cube detection member may be spaced apart from each other and arranged along the same line as the water detection member. The ice cube detection member may be disposed at a rear side of the crushed ice detection member. A first distance between the water detection member and the crushed ice detection member may be greater than a second distance between the crushed ice detection member and the ice cube detection member. The manipulation part may be rotatably mounted on a side of the dispenser, and the extension part may have a curvature corresponding to a rotating movement of the manipulation member. The detection members may be disposed to be spaced apart from each other along a curvature corresponding to a rotating movement of the manipulation member. The extension part may be supported by an elastic member, the elastic member being configured to, based on the manipulation member being manipulated, apply a force to the extension part to return the manipulation member to its original position. The control unit may be configured to control the valve and motor so that the valve and motor are driven based on a preset time elapsing after the selection of the manipulation member is detected. The display unit may be configured to display an elapsing state of the preset time based on the dispensing of the water or ice being selected according to a manipulated state of the manipulation member.

According to another aspect, a refrigerator includes a main body, a storage space defined within the main body, a door configured to open and close at least a portion of the storage space, a dispenser provided in the door, a water nozzle disposed on the dispenser to dispense water, an ice nozzle disposed on the dispenser and configured to dispense ice, the ice nozzle being arranged in a line with the water nozzle, a water manipulation member disposed under the water nozzle and configured to be manipulated to dispense water, a single ice manipulation member disposed under the ice nozzle, the ice manipulation member being configured to be manipulated in stages in a single direction to enable selection between dispensing of crushed ice and dispensing of ice cubes, a detection member disposed on the dispenser and configured to recognize manipulation of the ice manipulation member, and a control unit configured to control a motor to thereby dispense the water or ice according to an input of the detection member.

Implementations of this aspect may include one or more of the following features. For example, the manipulation member may be moved forward or backward to select dispensing of the crushed ice or ice cubes. The control unit may be configured to instruct the dispensing of the crushed ice or ice cubes based on a preset time elapsing after the selection of the ice manipulation members is detected. The control unit may be configured to determine the dispensing of the crushed ice or ice cubes by selecting a rotating operation of a blade for crushing the ice. The refrigerator may further include a display unit disposed on the dispenser to display the selected state of the ice to be dispensed according to a manipulated state of the manipulation member and elapsing of the preset time. The detection member may be provided in plurality, the plurality of detection members being arranged at a predetermined distance away from each other along a moving direction of the manipulation member. The plurality of detection members may be configured to contact the manipulation member to enable determination of the dispensing of the crushed ice or ice cubes after an entirety of the ice manipulation member passes under the ice nozzle. The detection member for dispensing the ice cube of the plurality of detection members may be disposed at a rear side of the detection member for dispensing the crushed ice. The manipulation member may include one of a recess part and a contact protrusion, and the dispenser includes the other of the recess part and the contact protrusion, shapes of the recess part and the contact protrusion complementing each other such that the movement of the manipulation member is selectively restricted at positions of the manipulation member that correspond to dispensing positions for the crushed ice or ice cubes.

According to another aspect, a method for controlling a refrigerator, wherein a water nozzle for dispensing water and an ice nozzle for dispensing ice are disposed on a dispenser provided in a refrigerator door, and a single manipulation member is disposed under the ice nozzle, includes manipulating the manipulation member in a single direction in stages to correspondingly select and dispense either the water or ice, and controlling a valve or a motor of the refrigerator for each manipulation stage of the manipulation member.

Implementations of this aspect may include one or more of the following features. For example, the method may include manipulating the manipulation member by moving the manipulation member along the single direction to be in a first stage to thereby cause dispensing of the water, and manipulating the manipulation member to be in a second stage by further moving the manipulation member in the same direction to thereby cause dispensing of the ice. The manipulation in the second stage may be divided into an ice cube dispensing process for dispensing an ice cube and a crushed ice dispensing process for dispensing crushed ice according to a moving distance of the manipulation member. The method may further include selecting the ice cube dispensing process based on the manipulation member further moving in comparison to the crushed ice dispensing process. The method may further include, based on a set process following the manipulation of the manipulation member being maintained for a preset time, starting the dispensing of the water or ice from the water nozzle or the ice nozzle. The method may further include, based on the manipulation member moving out of a position corresponding to the set process before elapsing of the preset time, canceling a dispensing manipulation signal of the water or ice. The method may further include, based on the manipulation member moving to a position corresponding to another process before elapsing of the preset time, converting to the other corresponding dispensing selection while the manipulation is moving, and dispensing the selected water or ice based on the manipulation member being maintained for the preset time in total during the set processes. The method may further include displaying on a display unit a selection state of the water or ice according to the manipulation of the manipulation member and an elapsing state of the preset time, wherein the display unit is disposed the dispenser.

The details of one or more implementations are set forth in the accompanying drawings and the description below. Other features will be apparent from the description and drawings, and from the claims.

DETAILED DESCRIPTION

Reference will now be made in detail to the implementations of the present disclosure, examples of which are illustrated in the accompanying drawings. The technical scope of the implementations will fall within the scope of this disclosure, and addition, deletion, and modification of components or parts are possible within the scope of the implementations.

For convenience of description and understanding of a refrigerator according to implementations, although a refrigerator in which a refrigerating compartment is disposed above a freezing compartment, and a pair of doors is disposed on left and right sides of the refrigerating compartment is described as an example, the refrigerator may be applied all types of refrigerators including a dispenser in a refrigerator door.

Figure 1:
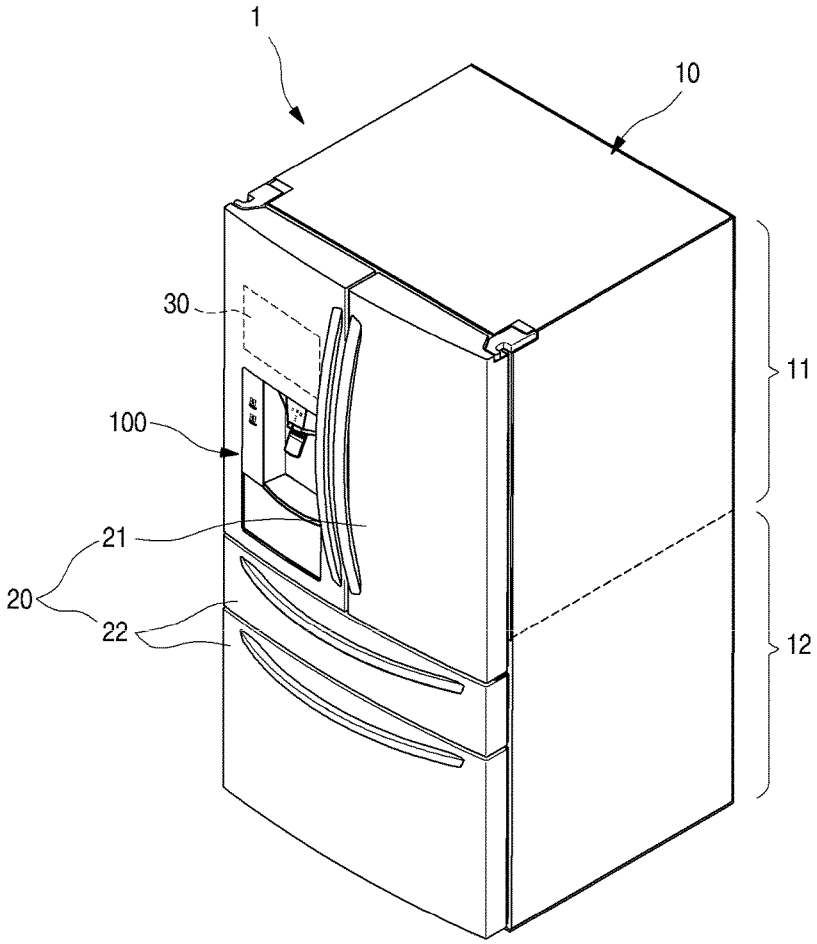
FIG. 1 is a perspective view showing an example refrigerator according to a first implementation.

FIG. 1 shows a refrigerator according to a first implementation.

Referring to FIG. 1, a refrigerator 1 according to a first implementation includes a main body 10 defining a storage space and a door 20 disposed on the main body 10 to open/close the storage space. As shown, the whole outer appearance of the refrigerator 1 may be defined by the main body 10 and the door 20.

The storage space within the main body 10 may be vertically partitioned to define a refrigerating compartment 11 at an upper side and a freezing compartment 12 at a lower side. As shown, the lower storage space may be partitioned into a plurality of compartments so that at least one of the plurality of compartments is used as the refrigerating compartment or other storage space. In some cases, the lower storage space may be provided as one space and also opened or closed by a plurality of doors.

The door 20 may include a refrigerating compartment door 21 for opening/closing the refrigerating compartment 11 and a freezing compartment door 22 for opening/closing the freezing compartment 12.

The refrigerating compartment door 21 may be provided in a pair on both left and right sides. Also, the refrigerating compartment door 21 may be rotatably mounted on the main body 10 to open or close the whole or a portion of the refrigerating compartment 11.

Also, the freezing compartment door 22 may be slidably inserted into or withdrawn from the freezing compartment 12 in a drawer type. A basket may be mounted on a back surface of the freezing compartment door 22. Here, the basket may also be inserted into or withdrawn together with the freezing compartment door 22. The freezing compartment door 22 may be provided in plurality. The plurality of freezing compartment doors 22 may be vertically disposed to form independent storage spaces.

A dispenser 100 may be disposed in the refrigerator compartment door 21. The dispenser 100 is configured to dispense water supplied from a water supply source or ice supplied from an ice making assembly 30 in a state where the refrigerating compartment door 21 is closed. Here, the dispenser 100 may dispense the water or ice to the outside by user's manipulation.

Although the dispenser 100 is disposed on one of the pair of refrigerating compartment doors 21 (hereinafter, referred to as a "door"), the dispenser 100 may be mounted in various positions according to the particular structure and configuration of the refrigerator.

Also, the water supply source for supplying water into the dispenser 100 may be a water pipe disposed outside the refrigerator 1 and connected to the refrigerator 1 or a water tank provided in the refrigerator 1. As shown, a water purifying filter and valve (see reference numeral 40 of FIG. 4) may be further provided in a water supply passage connected to the dispenser 100 to supply purified water into the dispenser 100.

Also, the ice making assembly 30 may be disposed on the back surface of the door 21 in which the dispenser 100 is disposed or an inner side of the main body 10. The ice making assembly 30 has a structure in which ice may be made by using water supplied from the water supply source, and the made ice can be stored and dispensed to the outside through the dispenser 100 when the dispenser 100 is manipulated.

The stored ice may be dispensed in an ice cube state. Also, a blade for crushing the stored ice while the stored ice is transferred by the user's manipulation to dispense crushed ice and a motor (see reference numeral 31 of FIG. 4) for rotating the blade may be provided in the ice making assembly 30.

Figure 2:
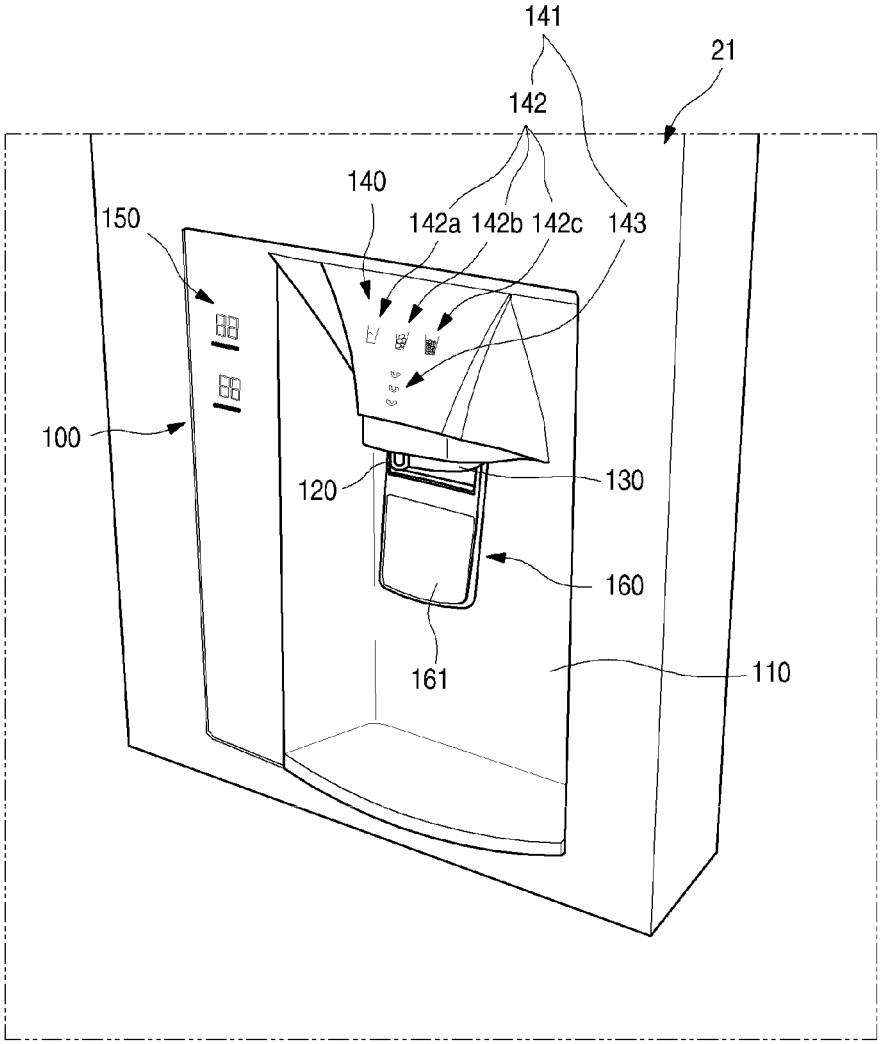
FIG. 2 is a perspective view showing an example dispenser according to the first implementation.
Figure 3:
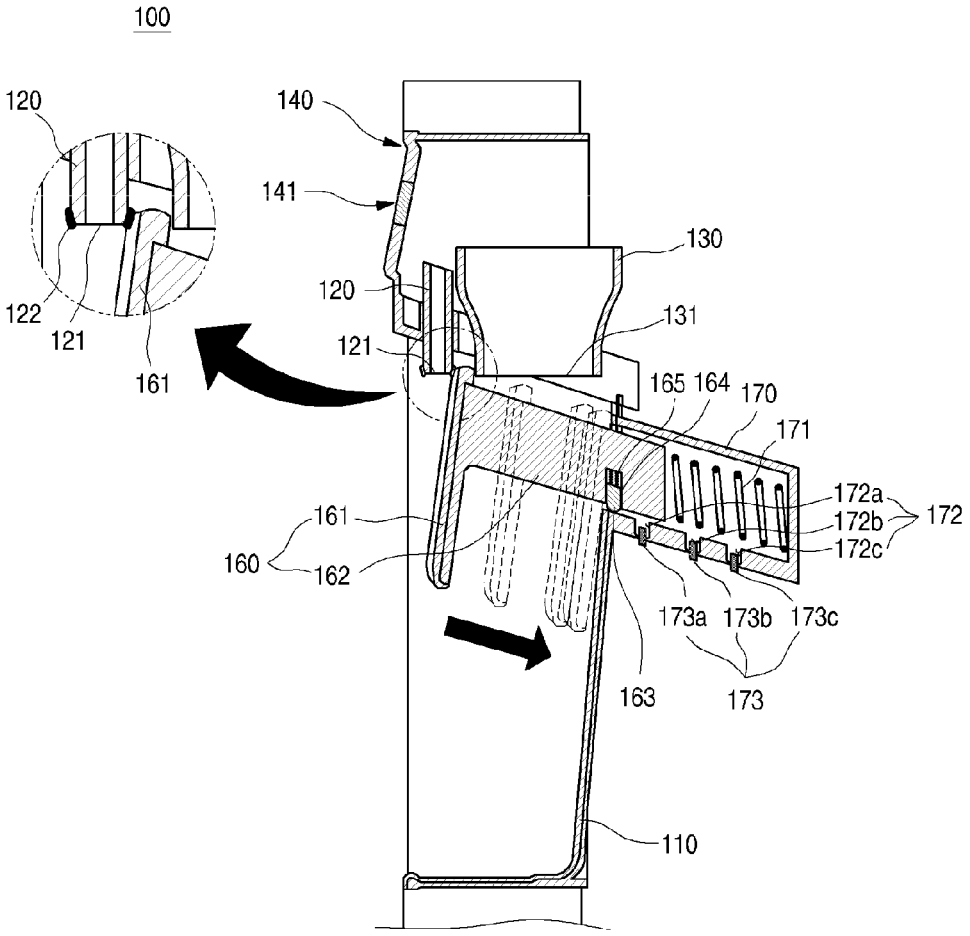
FIG. 3 is a cross-sectional view of the dispenser.
Figure 4:
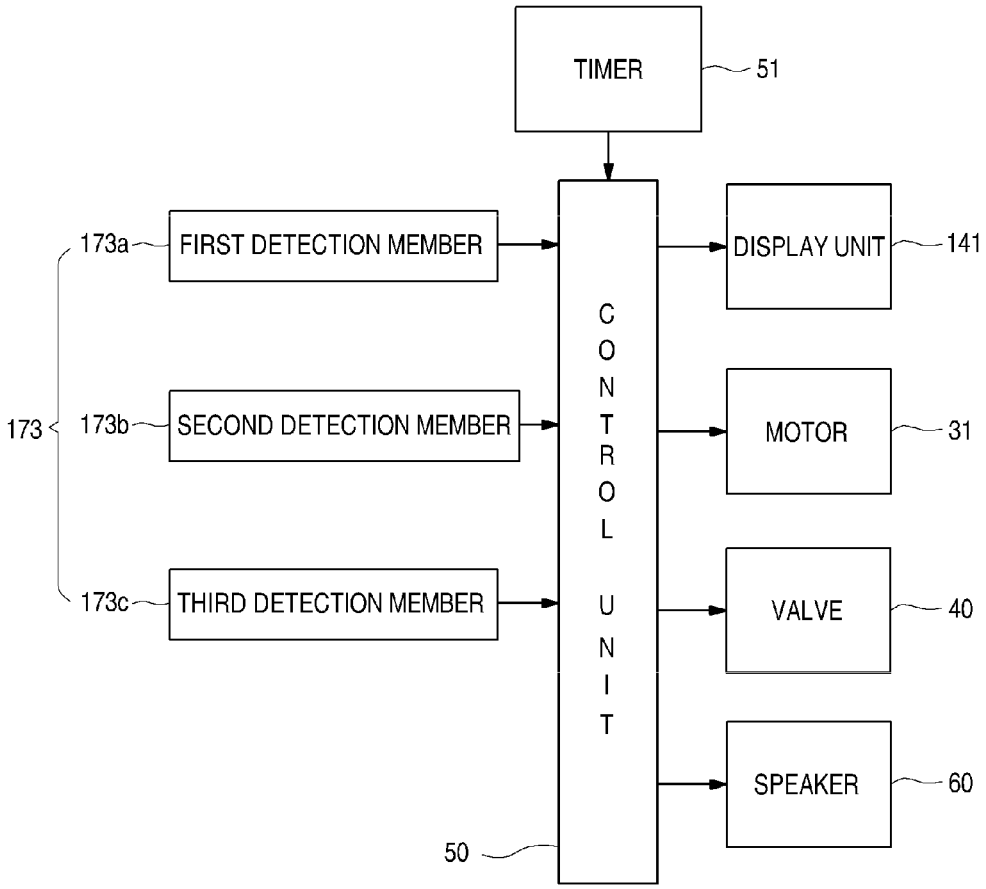
FIG. 4 is a block diagram illustrating an example flow of a control signal for driving the dispenser.

Referring to FIGS. 2 to 4, the dispenser 100 may include a dispenser case 110 providing a space that is recessed from a front surface of the door 21, water and ice nozzles 120 and 130 for dispensing water and ice, a cover 140 for covering at least a portion of a front side of the water and ice nozzles 120 and 130, a manipulation member 160 for manipulating selection and dispensing of the water or ice, and a display unit 141 for displaying an operation state of the refrigerator 1.

In more detail, the dispenser case 110 is disposed on the front surface of the door 21 and provides a space that is recessed inward to accommodate a container such as a cup when the water or ice is dispensed.

The dispenser case 110 can have a flat bottom surface on which the container may be placed. The manipulation member 160 may be manipulatably mounted on a rear surface of the dispenser case 110.

Also, the water nozzle 120 and the ice nozzle 130 extend downward from a top surface of the dispenser case 110.

The water nozzle 120 is configured to dispense the purified water and can have a tube shape. Also, the water nozzle 120 extends from the water supply source to the dispenser 100 through the inside of the door 21. As shown in FIG. 3, an open outlet 121 of the water nozzle 120 may face a lower side.

Also, a stopper 122 may further be provided on the water nozzle 120. The stopper 122 may contact the manipulation member 160 before the manipulation member 160 is manipulated. The stopper 122 may be formed of a rubber or silicon material to buffer an impact when the manipulation member 160 returns to its original position.

That is, the stopper may be disposed on a position at which the water nozzle 120 contacts the manipulation member 160 when the manipulation member 160 returns to its original position by an elastic member 171 before or after the manipulation member 160 is manipulated.

The stopper 122 may have a ring shape and may also be disposed on a lower portion of the water nozzle 120. In some cases, the stopper 122 may not be disposed on the water nozzle 120, but instead be attached to an upper end of the manipulation member 160 in a pad shape to contact an outer surface of the water nozzle 120 when the manipulation member 160 contacts the water nozzle 120.

The ice nozzle 130 is disposed at a rear side of the water nozzle 120 to form a passage through which ice transferred from the ice making assembly 30 is dispensed. The ice nozzle 130 may have a diameter greater than that of the water nozzle 120 so that the ice is dispensed. The ice nozzle 130 is connected to an ice chute disposed in the door 21, and an open outlet 131 of the ice nozzle 130 faces a lower side.

The water nozzle 120 and the ice nozzle 130 may be disposed in a front/rear direction and arranged in a line. The water nozzle 120 may be spaced apart from the ice nozzle 130 to secure a manipulation distance of the manipulation member 160. In some cases, the water nozzle 120 may be disposed at a rear side of the ice nozzle 130. Alternatively, the water nozzle 120 may be disposed such that it contacts the ice nozzle 130.

A cover 140 surrounding the water nozzle 120 and the ice nozzle 130 may be disposed on an upper portion of the dispenser case 110. The cover 140 is disposed on a front side of the water nozzle 120 and the ice nozzle 130 to cover the water nozzle 120 and the ice nozzle 130. As shown, a lower end of each of the water nozzle 120 and the ice nozzle 130 may be exposed so that user distinguishes the water nozzle 120 and the ice nozzle 130 to allow the user to easily determine a position of the container.

A display unit 141 may be disposed on a front surface of the cover 140. The display unit 141 is configured to display the selected state and operation state of the dispenser 100 that is manipulated by the manipulation member 160. Since the display unit 141 is disposed above the same extension line as the manipulation member 160, when the manipulation member 160 is manipulated, the user may easily recognize positions of the manipulation member 160 and a container 2 (FIG. 6) and a state of the display unit 141 at the same time.

The display unit 141 may be displayed in an icon shape. Alternatively, the display unit 141 may be turned on/off on an area that is set by a light emitting member to display the state.

For example, as illustrated in FIG. 2, the display unit 141 may include an upper selection state display part 142 and a lower progression state display part 143.

The selection state display part 142 may display a dispensing mode that is selected by the user. For example, a water dispensing mode 142*a*, an ice cube dispensing mode 142*b*, and a crushed ice dispensing mode 142*c* may be displayed on the selection state display part 142. When the user does not manipulate the dispenser 100, all of the above-described modes can be turned off. When the user manipulates the manipulation member, the corresponding manipulation mode may be turned on.

In some cases, the progression state display part 143 may display a state in which a preset time elapses in a state where the user manipulates the manipulating the manipulation member 160 to select the dispensing mode. For this, the progression state display part 143 may include a plurality of turn on/off areas in a vertical direction. As time elapses, the number of turn on/off areas, which are turned on, may increase. Thus, the user may confirm that the preset time is satisfied in the selected dispensing mode by confirming a variation of the number of turn on/off areas.

Thus, when a manipulation signal of the manipulation member 160 is transmitted into a control unit 50, the selected mode may be displayed on the selection state display part 142. Simultaneously, when the display of the progression state display part 143 is completed for the preset time for confirming the selected mode, the control unit 50 may control the dispenser 100 to dispense water or ice according to the selected mode.

A main display unit 150 may be further provided on a side of the dispenser case 110. The main display unit 150 can display an operation state of the refrigerator. That is, the main display unit 150 may display a temperature or operation state of the refrigerator.

In some cases, the display unit 141 and the main display unit 150 may be integrated with each other. A portion of the display unit 141, for example the selection state display part 142, may be provided on the main display unit 150, and the progression state display part 143 may be provided on the cover 140.

Also, the display unit 141 may be realized in various manners in addition to the turn on/off manner. For this, a speaker 60 for guiding the selected state by using voice may be further provided.

The manipulation member 160 is disposed under the water nozzle 120 and the ice nozzle 130. The manipulation member 160 is configured so that the user can push the manipulation member 160 to dispense water or ice at once.

The manipulation member 160 may include a manipulation part 161 and an extension part 162. The manipulation part 161 may be a portion that is pushed using the container 2 by the user. Thus, the manipulation part 161 may have a predetermined area. Also, the manipulation part 161 is spaced apart from a rear wall of the dispenser case 110 and mounted on the rear wall of the dispenser case 110 by the extension part 162.

The extension part 162 extends backward from a rear surface of the manipulation member 160. Then, the extension part 162 passes through the dispenser case 110 and is inserted into an extension part guide 170. An elastic member 171 is disposed inside the extension part guide 170. The extension part 162 may be supported by the elastic member 171.

Thus, when the manipulation member 160 is pushed, the extension part 162 is inserted along the extension part guide 170 to press the elastic member 171. Also, after the manipulation of the manipulation member 160 is completed, the manipulation member 160 may be returned to its original position by an elastic force of the elastic member 171.

The manipulation member 160 may be disposed to pass through regions of the water nozzle 120 and the ice nozzle 130 when being manipulated. Also, the selection and dispensing of water or ice may be determined according to a degree to which the manipulation member 160 is pushed.

In detail, a contact protrusion 163 protruding outward may be disposed on a side of the extension part 162. The contact protrusion 163 may be accommodated into a recess part 172, as will be described later. An end of the contact protrusion 163 may be rounded to easily pass through the recess part 172.

The contact protrusion 163 may be provided as a separate member and inserted into a protrusion groove 164 disposed on the extension part 162. The contact protrusion 163 may be supported by a spring 165 and have an end that is exposed to the outside. Thus, the contact protrusion 163 may be inserted into or withdrawn from the protrusion groove 164 according to the manipulation of the manipulation member 160. In some cases, the contact protrusion 163 may not be molded as a separate member, but instead be integrated with the extension part 162 to protrude outward.

The recess part 172 is defined in an inner side surface of the extension part guide 170 that in contact with the contact protrusion 163. The recess part 172 may be provided in plurality, and the plurality of recess parts 172 may be disposed to be spaced a preset distance from each other. When water or ice is selected by the manipulation member 160, two recess parts 172 may be defined. As described in the current implementation, when water, crushed ice, and ice cube are selected, three recess parts 172 may be defined.

The recess part 172 may accommodate the contact protrusion 163, and a detection member 173 is provided inside the recess part 172. The detection member 173 may contact the contact protrusion 163 like a switch to transmit a signal to the control unit 50.

The recess part 172 may be positioned according to a position of the manipulation member 160. For example, a first recess part 172*a* may be defined in the foremost side of the recess parts 172 may be defined in a position corresponding to that of the contact protrusion 163 after the manipulation member 160 passes through the water nozzle 120. Thus, when the user manipulate the manipulation member 160 to allow the contact protrusion 163 to be disposed in the first recess part 172*a*, a detection signal detected by the first detection member 173*a* can be transmitted to the control unit 50. Thus, the control unit can open a valve connected to the water nozzle 120 to dispense water.

Also, a second recess part 172*b* may be defined in a rear side of the first recess part 172*a*. The second recess part 172*b* may be defined in a position at which the manipulation member corresponds to the rearmost end of the ice nozzle 130 or a position corresponding to that at which the contact protrusion 163 is disposed after passing through the ice nozzle 130. Thus, when the user manipulates the manipulation member 160 to allow the contact protrusion 163 to be disposed in the second recess part 172*b*, a detection signal detected by the second detection member 173*b* can be transmitted to the control unit 50. Thus, the control unit 50 may drive the motor 31 of the ice making assembly 30 to allow the crushed ice to be dispensed through the ice nozzle 130.

Also, a third recess part 172*c* may be defined in a rear side of the second recess part 172*b*. The third recess part 172*c* may be defined in a position corresponding to that at which the contact protrusion 163 is disposed in a state where the manipulation member 160 completely passes through the ice nozzle 130. Thus, when the user manipulates the manipulation member 160 to allow the contact protrusion 163 to be disposed in the third recess part 172*c*, a detection signal detected by the third detection member 173*c* can be transmitted to the control unit 50. Thus, the control unit 50 may drive the motor 31 of the ice making assembly 30 to allow the stored ice cube to be dispensed through the ice nozzle 130.

A distance from the first recess part 172*a* to the second recess part 172*b* can be greater than that from an initial position of the manipulation member 160 to the first recess part 172*a*. This is because the ice nozzle 130 has a diameter greater than that of the water nozzle 120. So by being configured in this manner, the manipulation member 160 may be sufficiently deeply pushed so that the dispensed ice is stably dispensed into the container 2.

Also, the third recess part 172*c* should be disposed at further rear side from the second recess part 172*b*. This is so that the ice cube, which has a size greater than the crushed ice, can be stably dispensed into the container 2 when the ice cube is dispensed through the ice nozzle 130 because the ice cube is dispensed in a state where the contact protrusion 163 is disposed on the third recess part 172*c*.

Even though the control unit 50 receives a manipulation selection signal from the detection member 173 that is disposed on the recess part 172 by the manipulation member 160, water or ice may not be immediately dispensed, but instead be dispensed after the preset time elapses.

That is, when a signal for selecting a mode is inputted by manipulating the manipulation member 160, the control unit 50 may control the display unit 141 so that the mode selected by the manipulation member 160 is displayed on the display unit 141. Simultaneously, the control unit 50 may count the elapsed time to allow the display unit 141 to display the elapsing time.

Thus, the user need only to stand by for the preset time without additionally manipulating the manipulation member 160 in the state where the mode is selected so as to receive the water or ice when the manipulation member 160 for selecting the water or ice is manipulated. Also, when the manipulation member 160 is further manipulated in the same straight-line direction in the state where the preset time does not elapse due to malfunction or for converting the selected mode into the other mode, the selection mode for the water or ice may be converted. Then, when the preset time elapses again, newly selected water or ice may be dispensed.

Hereinafter, an operation of the dispenser having the above-described structure according to the first implementation will be described with reference to the accompanying drawings.

Figure 5:
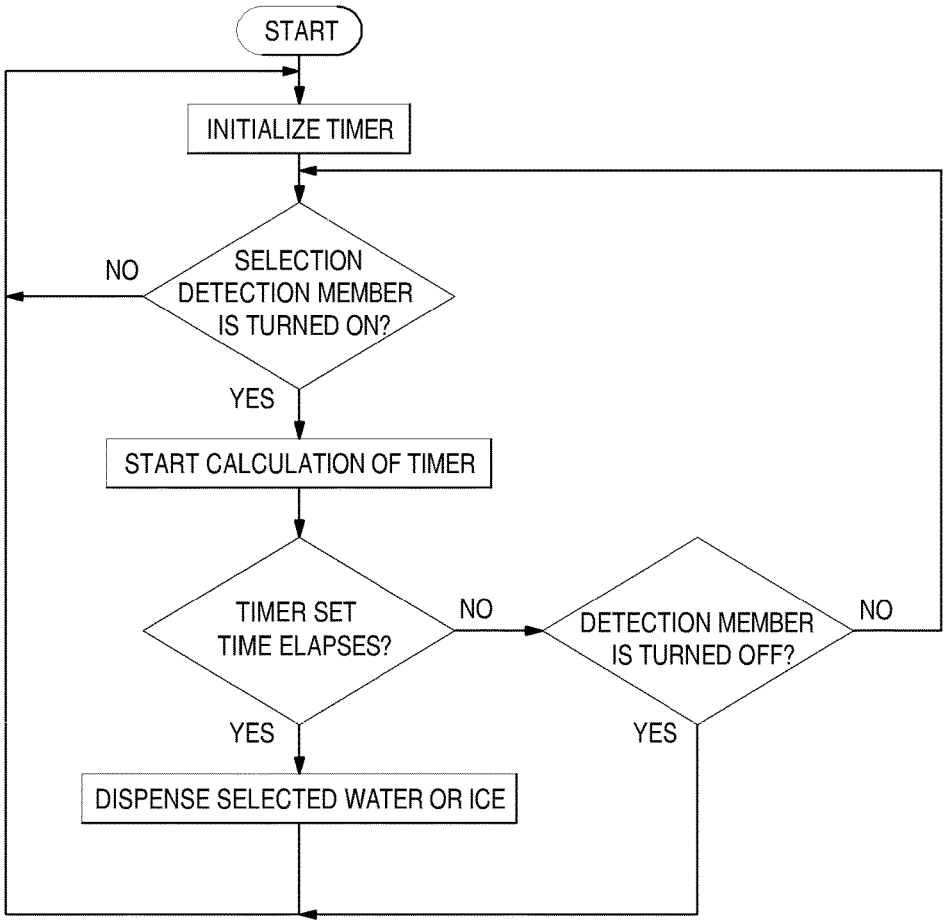
FIG. 5 is a flowchart illustrating an example operation process of the dispenser.
Figure 6:
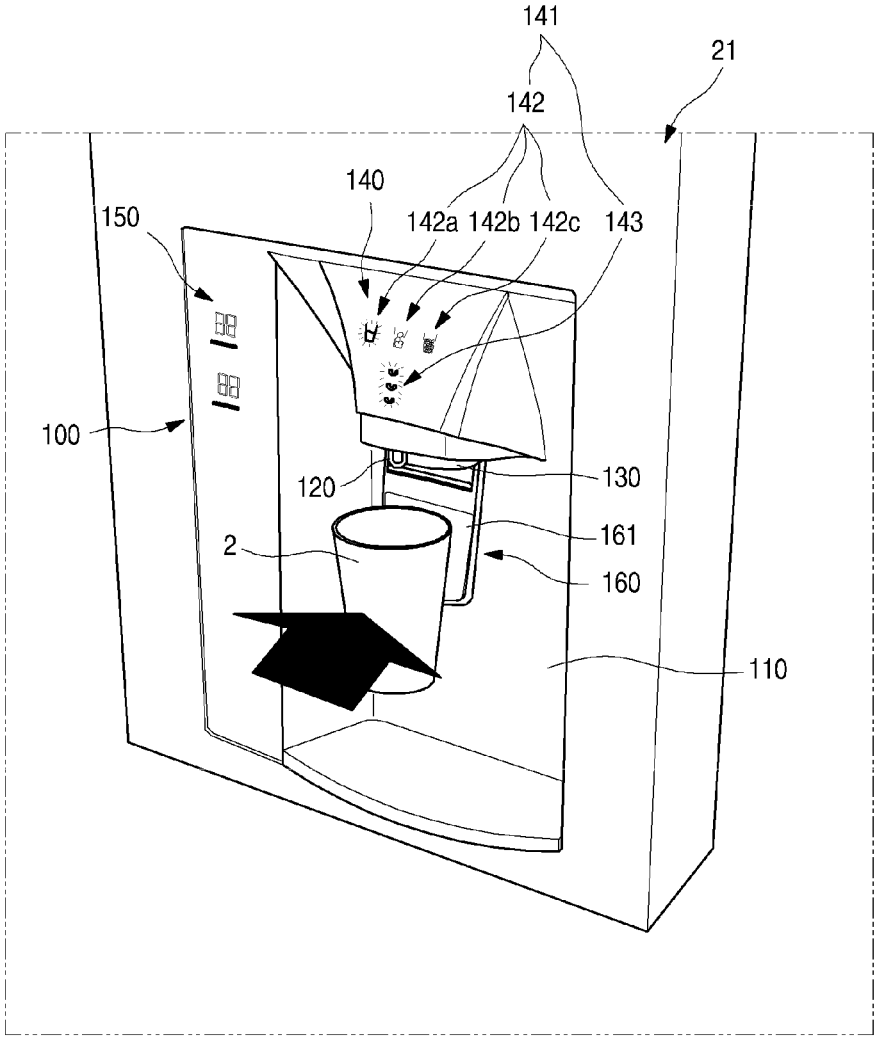
FIG. 6 is a perspective view of the dispenser in a water dispensing manipulation state.
Figure 7:
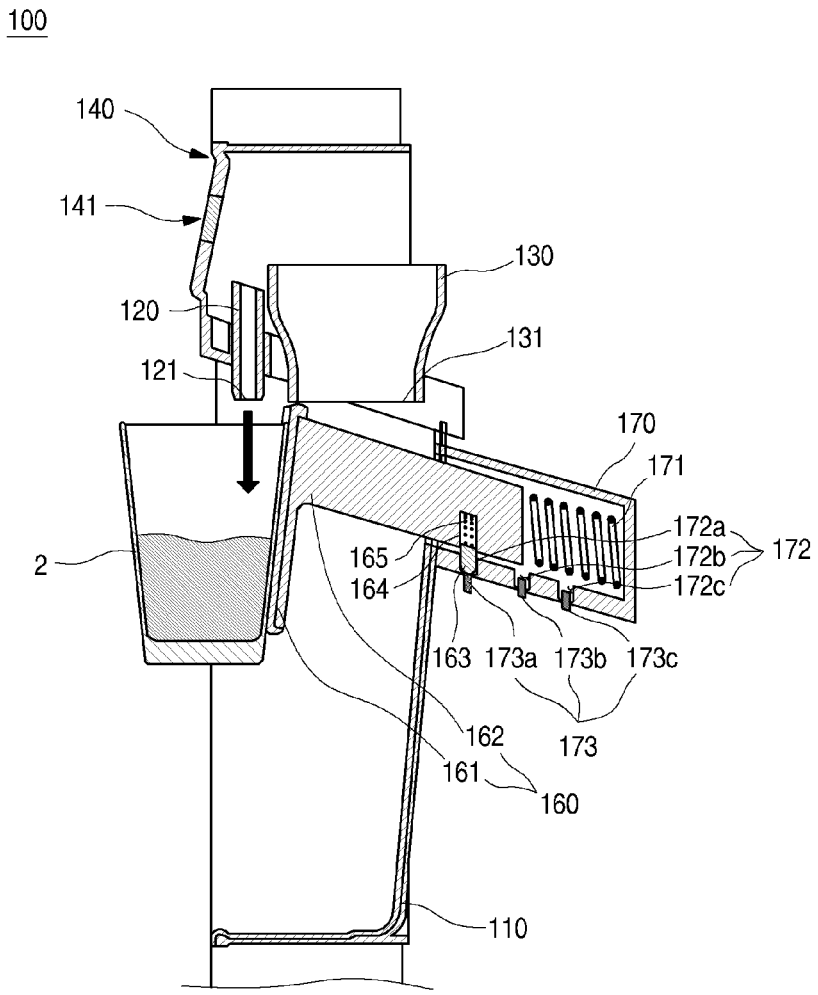
FIG. 7 is a cross-sectional view of the dispenser in the water dispensing manipulation state.

FIG. 5 illustrates an example operation process of the dispenser. FIGS. 6 and 7 show the dispenser in the water dispensing manipulation state.

Referring to FIGS. 5 to 7, the user can push the manipulation member 160 first to dispense water. When the manipulation member 160 is pushed, the extension part 162 may move backward to press the elastic member 171.

The user may confirm the water nozzle 120 that is exposed through the cover 140 when the manipulation member 160 is manipulated. Then, the user may manipulate the manipulation member 160 so that the manipulation member 160 reaches a position for receiving water via the water nozzle 120.

The above-described manipulation may be performed based on the user's intuition (i.e. without further feedback from the dispenser). Also, when the contact protrusion 163 disposed on the extension part 162 is accommodated into the first recess part 172*a*, the manipulation member 160 may be hooked. In this state, the user may detect the manipulation of the manipulation member 160.

When the contact protrusion 163 is accommodated into the first recess part 172*a*, the first detection member 173*a* transmits a selection signal to the control unit 50. The control unit 50 may control the selection state display part 142 so that the water dispensing mode is turned on the selection state display part 142. That is, the user may also confirm the selection for dispensing water by confirming the selection state display part 142.

When the selection signal of the water dispensing mode is transmitted, the control unit 50 may transmit state information in which the preset time elapses or preset time information by using the timer to the display unit 141. Here, the control unit 50 may confirm the state information in which the preset time elapses through the progression state display part 143.

Also, when the preset time elapses in the state where the manipulated state of the manipulation member 160 is maintained, the whole areas of the progression state display part 143 may be turned on. Thus, the control unit 50 may open the valve 40 to supply water into the container 2 through the water nozzle 120.

After a desired amount of water is supplied, the user may separate the container from the manipulation member 160 to complete the manipulation. At this point, the manipulation member 160 may return to its original position by the restoring force of the elastic member 171 that supports the extension part 162 of the manipulation member 160. When the contact protrusion 163 comes out of the first recess part 172*a*, the control unit 50 may turn all of the selection state display part 142 and the progression state display part 143 off. Then, the dispenser 100 may return to a manipulation standby state again.

In some cases, even though the manipulation member 160 is not separated, the control unit 50 may close the valve 40 so that the supply of ice automatically is stopped after a preset amount of ice is dispensed.

Figure 8:
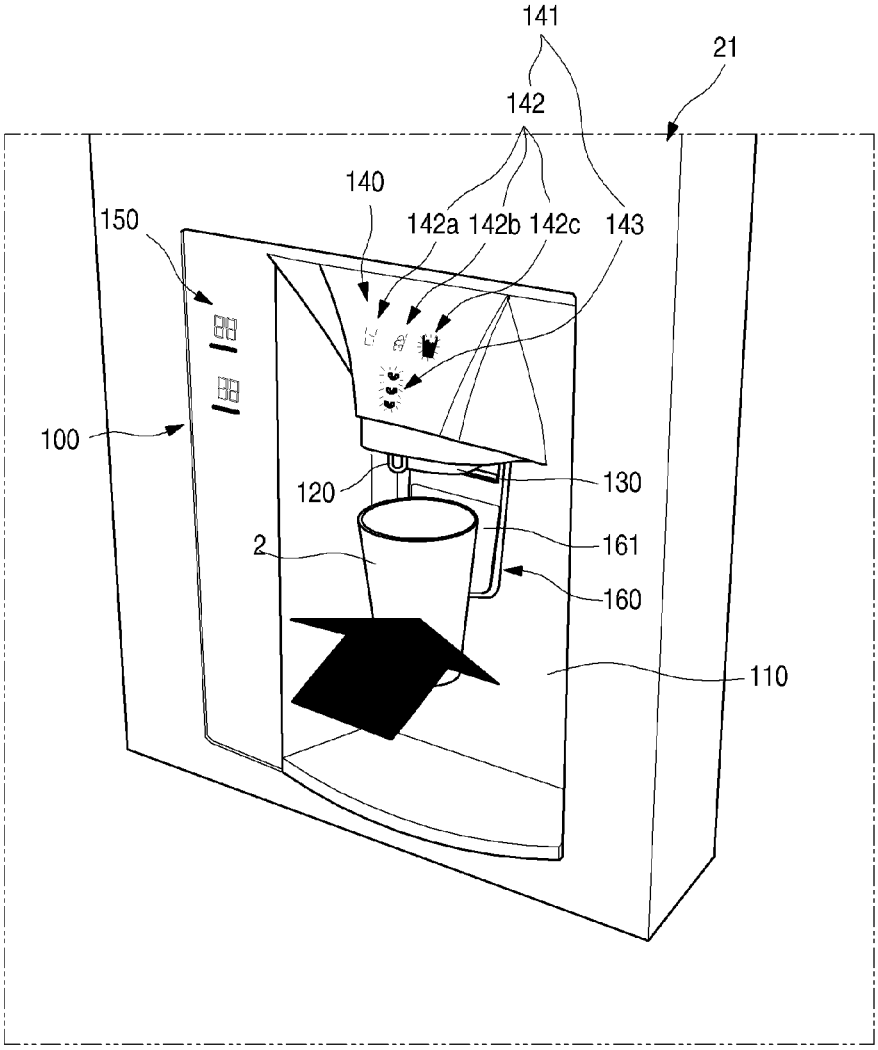
FIG. 8 is a perspective view of the dispenser in a crushed ice dispensing manipulation state.
Figure 9:
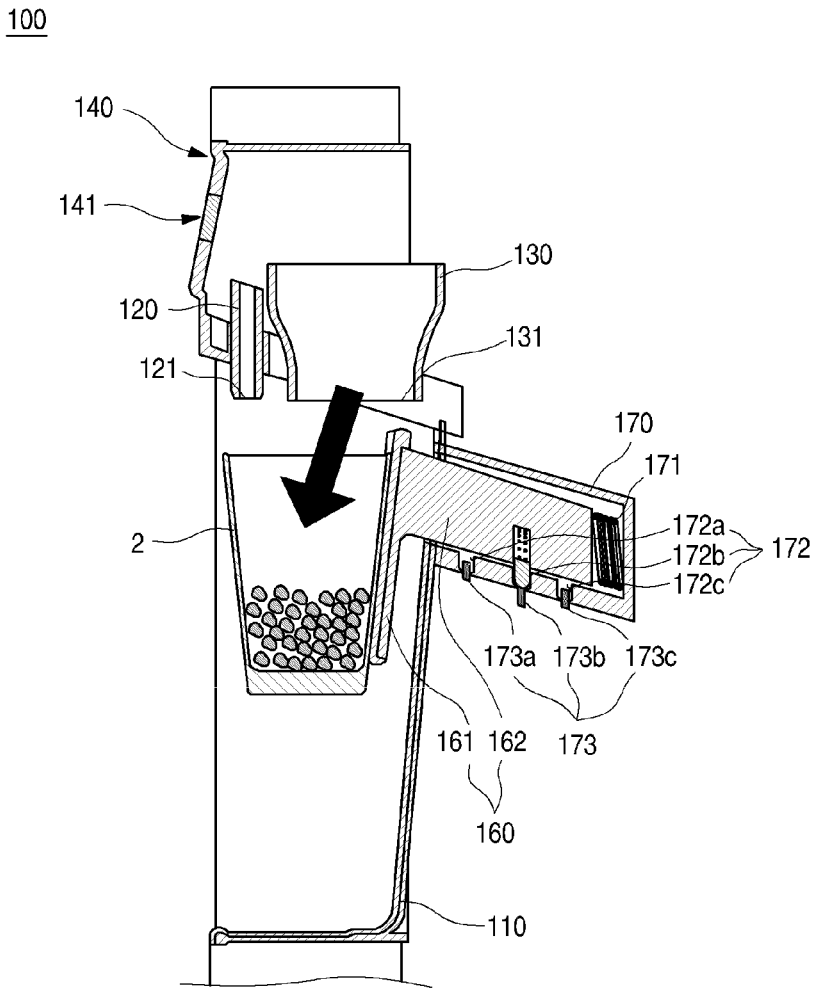
FIG. 9 is a cross-sectional view of the dispenser in the crushed ice dispensing manipulation state.

FIG. 8 shows the dispenser in a crushed ice dispensing manipulation state. Also, as illustrated in FIG. 9, to dispense the crushed ice, the user pushes the manipulation member 160. When the manipulation member 160 is pushed, the extension part 162 may move backward to press the elastic member 171.

The user may confirm the water nozzle 120 that is exposed through the cover 140 when the manipulation member 160 is manipulated. Then, the manipulation member 160 moves up to a rear end of the ice nozzle 130 or a portion that passes through the ice nozzle 130 via the water nozzle 120 to reach a position for receiving water.

The above-described manipulation may be performed based on the intuition of the user through the prediction of the position of the ice nozzle 130. Also, the contact protrusion disposed on the extension part 162 may be accommodated into the second recess part 172*b* to hook the manipulation member 160. In this state, the user may detect the selection manipulation of the manipulation member 160.

When the contact protrusion 163 is accommodated into the second recess part 172*b*, the second detection member 173*b* transmits a selection signal to the control unit 50. The control unit 50 may control the selection state display part 142 so that the crushed ice dispensing mode is turned on the selection state display part 142. That is, the user may also confirm the selection for dispensing the crushed ice by confirming the selection state display part 142.

When the selection signal of the crushed ice dispensing mode is transmitted, the control unit 50 may transmit state information in which the preset time elapses or preset time information by using the timer to the display unit 141. Here, the control unit 50 may confirm the state information in which the preset time elapses through the progression state display part 143.

Also, when the preset time elapses in the state where the manipulated state of the manipulation member 160 is maintained, the whole areas of the progression state display part 143 may be turned on. Thus, the control unit 50 may control the motor 31 so that the motor 31 rotates to crush ice, and then the crushed ice is discharged through the ice nozzle 130 to supply the crushed ice into the container 2.

After a desired amount of crushed ice is supplied, the user may separate the container from the manipulation member 160 to complete the manipulation. The manipulation member 160 may return to its original position by the restoring force of the elastic member 171 that supports the extension part 162 of the manipulation member 160. When the contact protrusion 163 comes out of the second recess part 172*b*, the control unit 50 may turn all of the selection state display part 142 and the progression state display part 143 off. Then, the dispenser 100 may return to a manipulation standby state again.

Also, even though the manipulation member 160 is not separated, the control unit 50 may stop the rotation of the motor 31 so that the supply of ice automatically is stopped after a preset amount of ice is dispensed.

Figure 10:
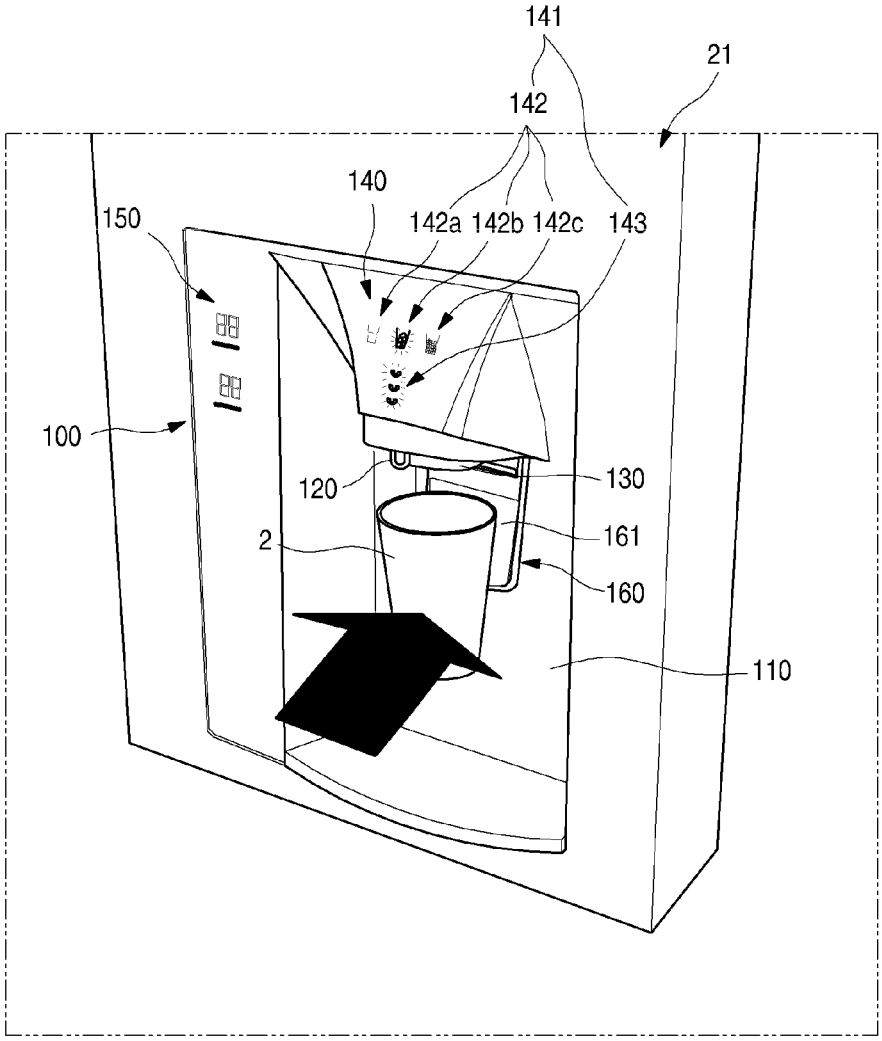
FIG. 10 is a perspective view of the dispenser in an ice cube dispensing manipulation state.
Figure 11:
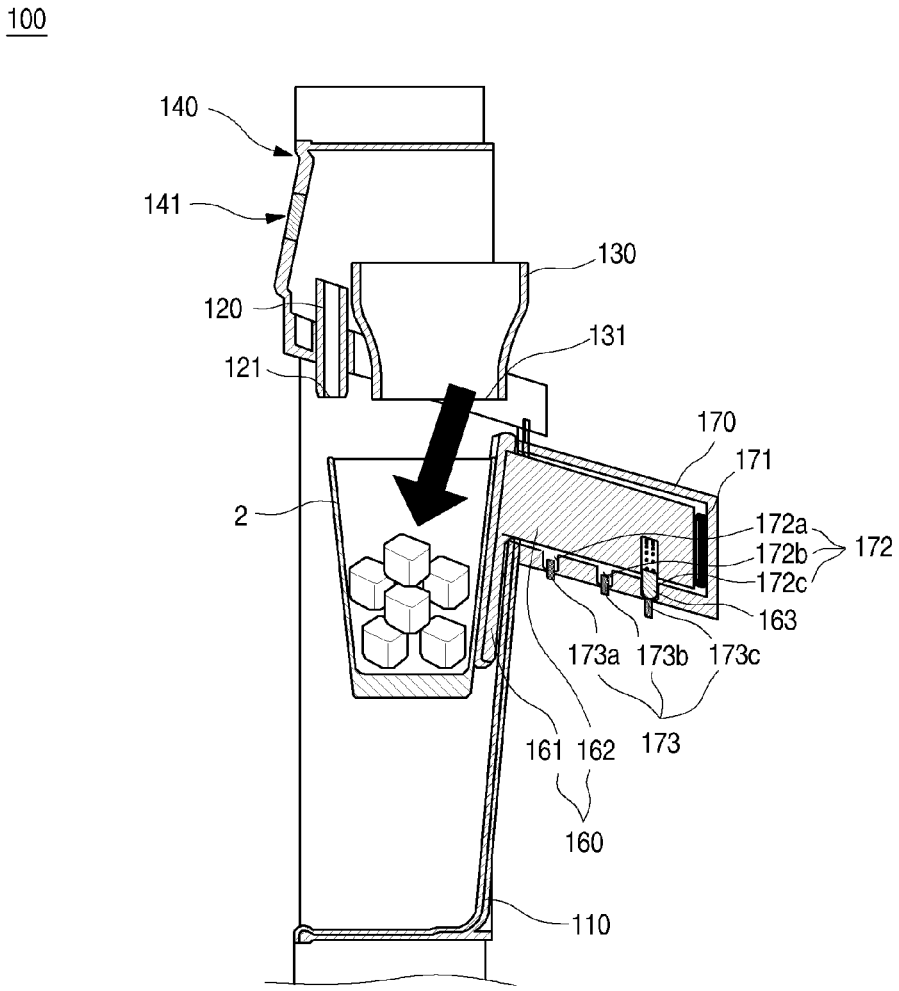
FIG. 11 is a cross-sectional view of the dispenser in the ice cube dispensing manipulation state.

FIGS. 10 and 11 show the dispenser in an ice cube dispensing manipulation state.

Referring to FIGS. 10 and 11, the user can push the manipulation member 160 first so as to dispense an ice cube. When the manipulation member 160 is pushed, the extension part 162 may move backward to press the elastic member 171.

Here, when the manipulation member 160 is manipulated, the user may manipulate the manipulation member 160 so that the manipulation member 160 moves by a distance greater than a manipulation distance for dispensing the crushed ice. Here, the user may manipulate manipulation member 160 so that the manipulation member 160 completely moves backward. That is, the user may manipulate the manipulation member 160 so that the manipulation member 160 moves up to a position passing through the ice nozzle 130 to reach a positing for receiving the ice.

The above-described manipulation may be performed based on the intuition of the user through the prediction of a recessed depth of the dispenser case 110. Also, the contact protrusion disposed on the extension part 162 may be accommodated into the third recess part 172*c* to hook the manipulation member 160. In this state, the user may detect the selection manipulation of the manipulation member 160.

When the contact protrusion 163 is accommodated into the third recess part 172*c*, the third detection member 173*c* transmits a selection signal to the control unit 50. The control unit 50 may control the selection state display part 142 so that the ice cube dispensing mode is turned on the selection state display part 142. That is, the user may also confirm the selection for dispensing the ice cube by confirming the selection state display part 142.

When the selection signal of the ice cube dispensing mode is transmitted, the control unit 50 may transmit state information in which the preset time elapses or preset time information by using the timer to the display unit 141. Here, the control unit 50 may confirm the state information in which the preset time elapses through the progression state display part 143.

Also, when the preset time elapses in the state where the manipulated state of the manipulation member 160 is maintained, the whole areas of the progression state display part 143 may be turned on. Thus, the control unit 50 may control the motor 31 so that the motor 31 rotates to discharge the ice cube stored in the ice making assembly 30 through the ice nozzle 130, thereby supplying the ice cube into the container 2.

After a desired amount of ice cube is supplied, the user may separate the container from the manipulation member 160 to complete the manipulation. Here, the manipulation member 160 may return to its original position by the restoring force of the elastic member 171 that supports the extension part 162 of the manipulation member 160. Here, when the contact protrusion 163 gets out of the third recess part 172*c*, the control unit 50 may turn all of the selection state display part 142 and the progression state display part 143 off. Then, the dispenser 100 may return to a manipulation standby state again.

Also, even though the manipulation member 160 is not separated, the control unit 50 may stop the rotation of the motor 31 so that the supply of ice automatically is stopped after a preset amount of ice is dispensed.

The manipulation of the manipulation member 160 as described above may be converted anytime when being desired by the user. Also, since the manipulation member 160 moves in the same line, the manipulation member 160 may move to dispense the ice after the water is dispensed first.

When the selection is converted due to the movement of the manipulation member 160, the manipulation member 160 has to move so that the selection state display part 141 is turned on. In the state where the selection state display part 141 is turned on, the manipulated state of the manipulation member 160 may be maintained for the preset time. Here, when it is confirmed that the preset time elapses through the progression state display part 141, the selected water or ice may be dispensed.

The refrigerator according to this disclosure may be applied in various implementations in addition to the foregoing implementation. Hereinafter, a refrigerator according to a second implementation will be described with reference to the accompanying drawings.

According to the second implementation, a plurality of springs for supporting a manipulation member is provided. When the manipulation member is manipulated, the manipulation member may contact the springs in stages to allow a user to effectively recognize the manipulation of the manipulation member.

The second implementation is equal to the foregoing implementation except for a structure of an elastic member. Thus, the same part will be designated by the same reference numeral, and detailed descriptions thereof will be omitted.

Figure 12:
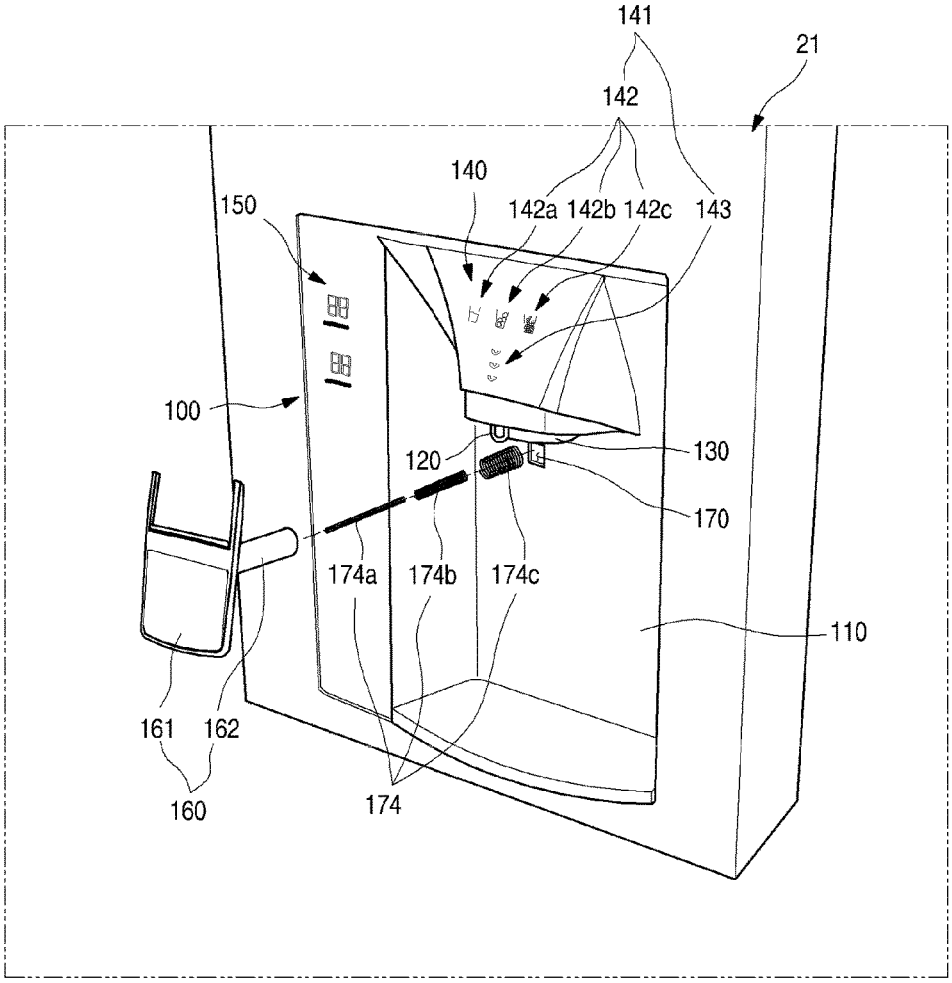
FIG. 12 is a perspective view showing an example dispenser according to a second implementation.
Figure 13:
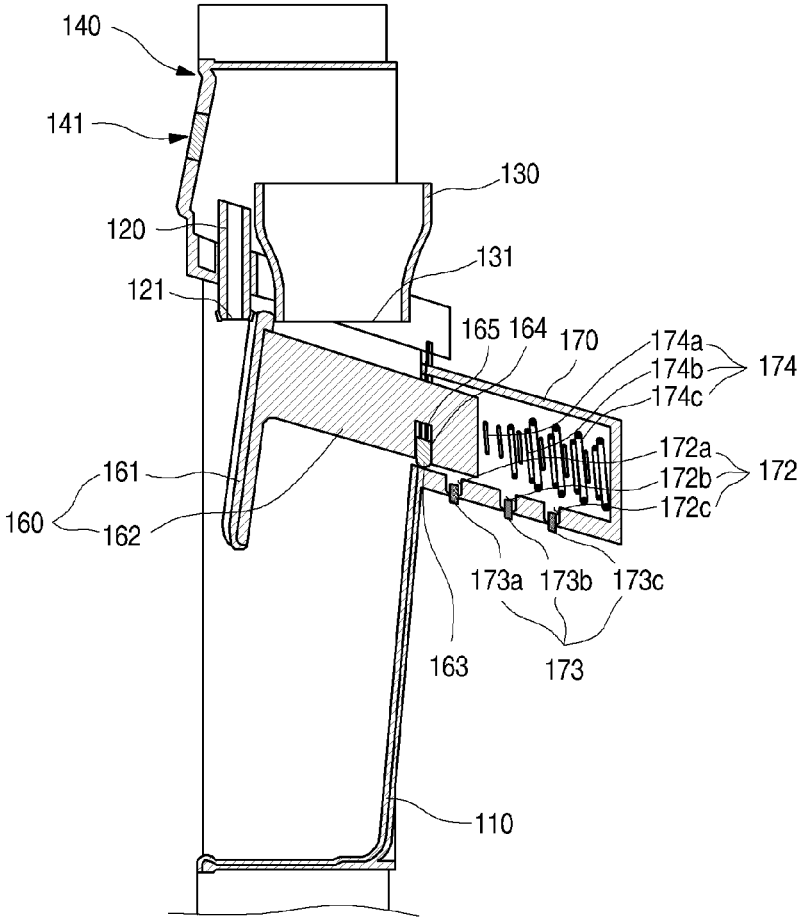
FIG. 13 is a cross-sectional view of the dispenser according to the second implementation.

FIGS. 12 and 13 show a dispenser according to a second implementation.

Referring to FIGS. 12 and 13, a dispenser 100 according to the second implementation is disposed in a front surface of the door 21 to form a space recessed by a dispenser case 110.

A water nozzle 120 and an ice nozzle 130 which extend downward are disposed on the dispenser case 110. The water nozzle 120 and the ice nozzle 130 may be arranged forward and backward in a line.

Also, a cover 140 is disposed on an upper portion of the dispenser case 110 to cover front sides of the water nozzle 120 and the ice nozzle 130. Also, a display unit 141 for displaying selected states of the water nozzle 120 and the ice nozzle 130 and elapsing of a preset time may be disposed on the cover 140. Also, a main display unit 150 for displaying an operation state of a refrigerator 1 may be further disposed on a side of the dispenser case 110.

The manipulation member 160 includes a manipulation part 161 that contacts the container 2 and an extension part 162 extending from the manipulation part 161. Also, the extension part 162 is inserted into an extension part guide 170 that is opened from a rear wall of the dispenser case 110.

A plurality of elastic members 174 are disposed on the extension part guide 170 to support the extension part 162. When the manipulation member 160 is pushed, a rear end of the extension part 162 may press the plurality of elastic members 174 in stages.

Also, a contact protrusion 163 protruding laterally is disposed on the extension part 162. A plurality of recess parts 172 are defined in the extension part guide 170 so that the contact protrusion 163 is accommodated in stages when the manipulation member 160 is pushed. Also, a detection member 175 is disposed on each of the plurality of recess parts 172. When contact with the contact protrusion 163 is detected, a selection signal may be transmitted to a control unit 50.

The number of elastic members 174 may be determined according to a manipulation process of the manipulation member 160. In the second implementation, first, second, and third elastic members 174*a*, 174*b*, and 174*c* may be provided to select water dispensing, crushed ice dispensing, and ice cube dispensing.

Also, three recess parts 172 may be provided to correspond to the elastic members 174. When the manipulation member 160 is manipulated to allow the contact protrusion 163 to be accommodated into the plurality of recess parts 172, the plurality of elastic members 174 may successively contact a rear end of the extension part 162.

The plurality of elastic members 174 may have the same central axis. Thus, the plurality of elastic members 174 may be accommodated to overlap each other and have lengths different from each other. When the user pushes the manipulation member 160 to allow the rear end of the extension part 162 to successively contact the plurality of elastic members 174, a large force for pressing the plurality of elastic members 174 is needed.

Also, the plurality of elastic members 174 may have elastic coefficients different from each other. Thus, user may predict a dispensing mode according to an increase of a force required for each of the elastic members 174.

Hereinafter, a state according to manipulation of the manipulation member in stages will be described with reference to the accompanying drawings.

Figure 14:
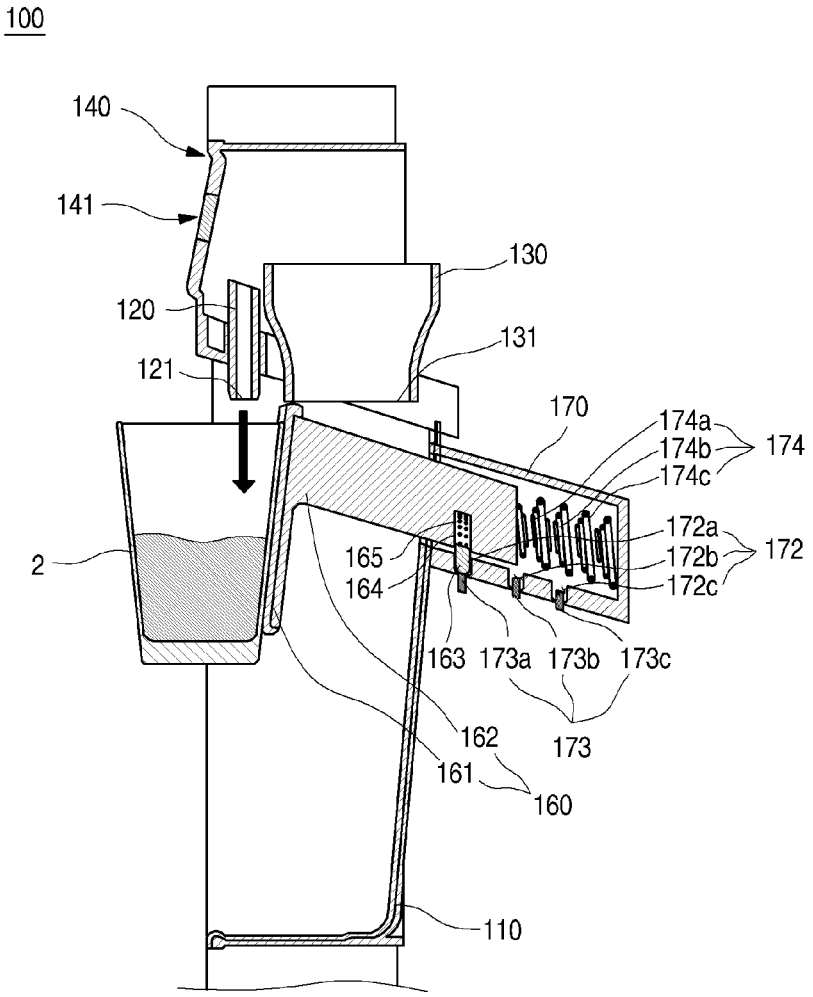
FIG. 14 is a cross-sectional view of the dispenser in a water dispensing manipulation state according to the second implementation.

FIG. 14 shows the dispenser in a water dispensing manipulation state according to the second implementation.

As illustrated in FIG. 14, when the container 2 that is used for dispensing water pushes the manipulation member 160 in a state where the container 2 contacts the manipulation part 161, the manipulation member 160 moves backward. Here, the container 2 may pass through an outlet 121 disposed on a bottom surface of the water nozzle 120 to move to a position for receiving water. Here, the first elastic member 174*a* is pressed while being pushed by the rear end of the extension part 162.

Also, when the user pushes the manipulation member 160 by a predetermined distance, the contact protrusion 163 may be accommodated into the first recess part 172*a*. Here, the user may feel the hooking of the contact protrusion 163. Simultaneously, the contact protrusion 163 may contact the first detection member 173*a*, and the first detection member 173*a* may transmit a water selection signal to a control unit 50.

When the contact protrusion 163 is accommodated into the first recess part 172*a*, the rear end of the extension part 162 is in contact with a front end of the second elastic member 174*b*. In this state, the second elastic member 174*b* is not pushed by fine manipulation. Thus, a force that is sufficient to press the second elastic member 174*b* has to be applied. Thus, the user may maintain a state in which the contact protrusion 163 is accommodated into the first recess part 172*a* to select the water selection mode.

In the selected state of the water selection mode, the water selection mode may be displayed on the selection state display part 142, and the elapsing of the preset time may be displayed on the progression state display part 143. Also, after the preset time elapses, the supply of the water through the water nozzle 120 may be enabled. When a preset amount of water is dispensed, or the contact between the contact protrusion 163 and the first detection member 173*a* is released, the control unit 50 stops the supply of the water.

Figure 15:
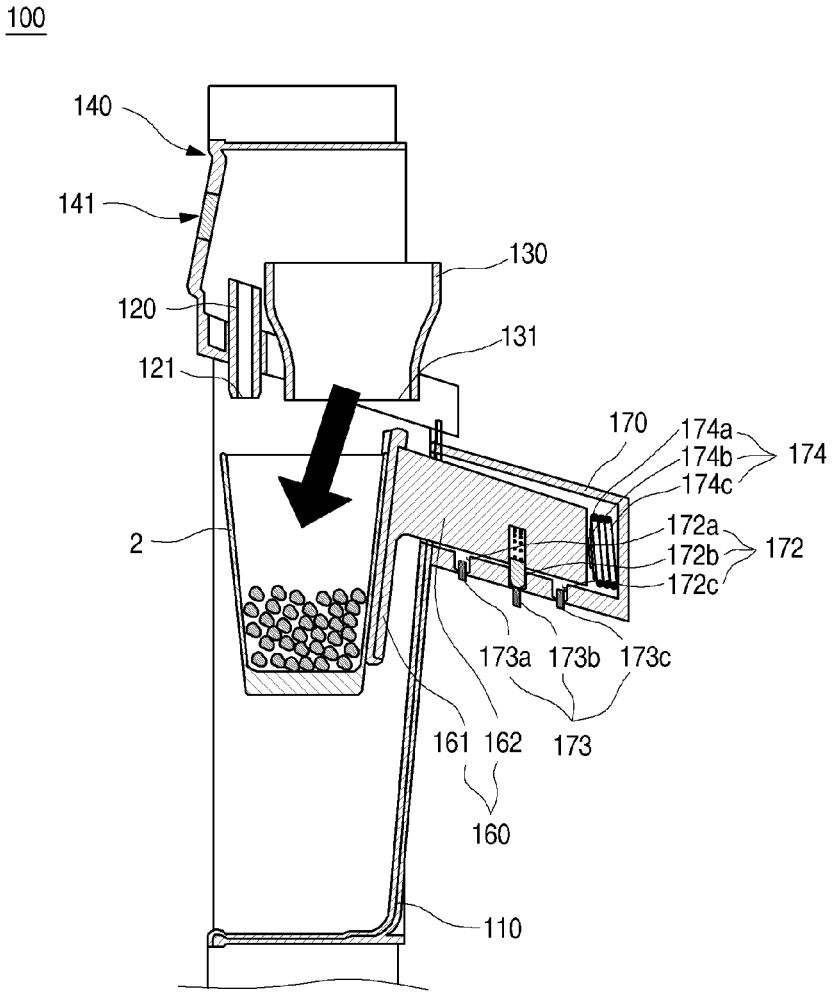
FIG. 15 is a cross-sectional view of the dispenser in a crushed ice dispensing manipulation state according to the second implementation.

FIG. 15 shows the dispenser in a crushed ice dispensing manipulation state according to the second implementation.

As illustrated in FIG. 15, when a container 2 that is used for dispensing crushed ice pushes the manipulation member 160 in a state where the container 2 contacts the manipulation part 161, the manipulation member 160 moves backward. Here, the container 2 may pass through an outlet 121 disposed on the bottom surface of the water nozzle 120 to move to a lower side of an outlet of the ice nozzle 130 so that the container 2 is disposed at a position for receiving the crushed ice. Here, the second elastic member 174*b* is pressed while being pushed by the rear end of the extension part 162.

Also, when the user pushes the manipulation member 160 by a predetermined distance, the contact protrusion 163 may be accommodated into the second recess part 172*b*. Here, the user may feel hooking of the contact protrusion 163. Simultaneously, the contact protrusion 163 may contact the second detection member 173*b*, and the second detection member 173*b* may transmit a crushed ice selection signal to a control unit 50.

When the contact protrusion 163 is accommodated into the second recess part 172*b*, the rear end of the extension part 162 is in contact with a front end of the third elastic member 174*c*. In this state, the third elastic member 174*c* may not be pushable by fine manipulation. Thus, a force large enough to press the third elastic member 174*c* has to be applied. Thus, the user may maintain a state in which the contact protrusion 163 is accommodated into the second recess part 172*b* to select the crushed ice selection mode.

In the selected state of the crushed ice selection mode, the crushed ice selection mode may be displayed on the selection state display part 142, and the elapsing of the preset time may be displayed on the progression state display part 143. Also, after the preset time elapses, the supply of the crushed ice through the ice nozzle 130 may be enabled. When a preset amount of crushed ice is dispensed, or the contact between the contact protrusion 163 and the second detection member 173*b* is released, the control unit 50 stops the supply of the crushed ice.

Figure 16:
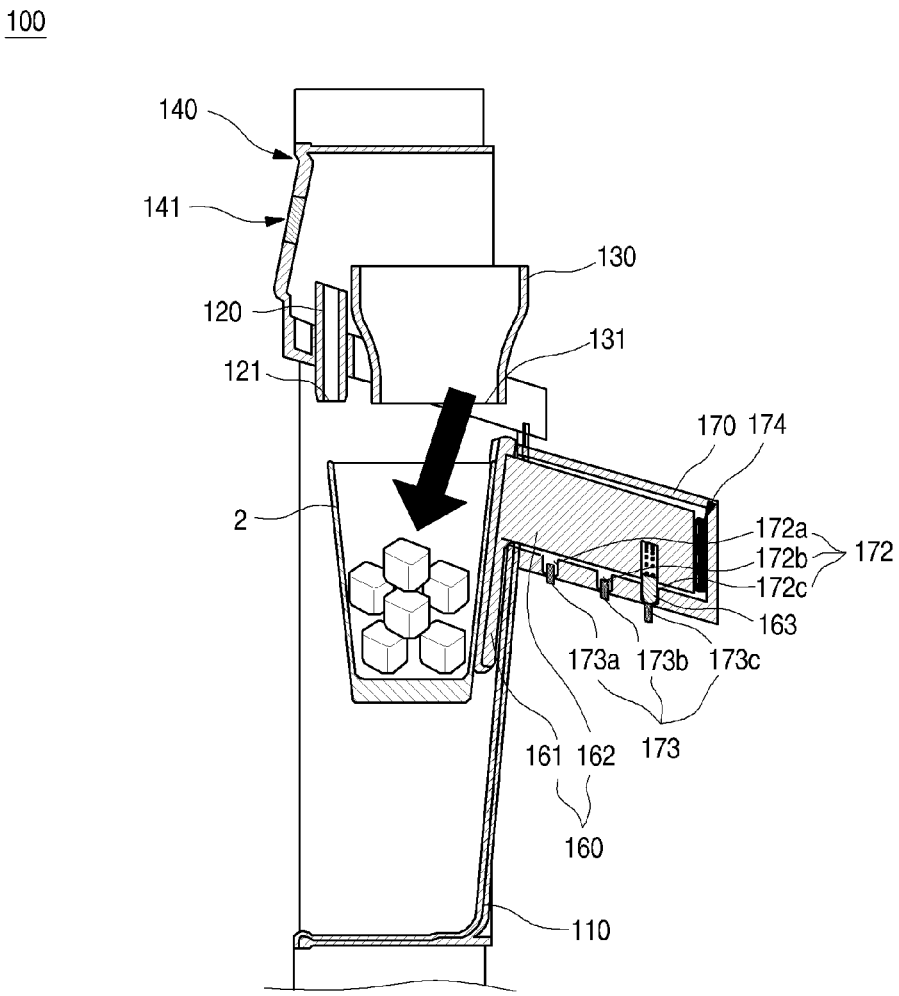
FIG. 16 is a cross-sectional view of the dispenser in an ice cube dispensing manipulation state according to the second implementation.

FIG. 16 shows the dispenser in an ice cube dispensing manipulation state according to the second implementation.

As illustrated in FIG. 16, when the container 2 that is used for dispensing an ice cube pushes the manipulation member 160 in a state where the container 2 contacts the manipulation part 161, the manipulation member 160 moves backward. Here, the container 2 may pass through the water nozzle 120 and the ice nozzle 130 to move to the rearmost position that is adjacent to the rear end of the ice nozzle 130 or a rear wall of the dispenser case 110 so that the container 2 is disposed at a position for receiving the ice cube. Here, all of the first, second, and third elastic members 174*a*, 174*b*, and 174*c* may be pushed and pressed by the rear end of the extension part 162.

Also, when the user pushes the manipulation member 160 by a predetermined distance, the contact protrusion 163 may be accommodated into the third recess part 172*c*. Here, the user may feel the hooking of the contact protrusion 163. Simultaneously, the contact protrusion 163 may contact the third detection member 173*c*, and the third detection member 173*c* may transmit an ice cube selection signal to the control unit 50.

When the contact protrusion 163 is accommodated into the third recess part 172*c*, the rear end of the extension part 162 may fully press the first, second, and third elastic members 174*a*, 174*b*, and 174*c*. In this state, the manipulation member 160 may move to the rearmost position. Thus, the user may maintain a state in which the contact protrusion 163 is accommodated into the third recess part 172*c* to select the ice cube selection mode.

In the selected state of the ice cube selection mode, the ice cube selection mode may be displayed on the selection state display part 142, and the elapsing of the preset time may be displayed on the progression state display part 143. Also, after the preset time elapses, the supply of the ice cube through the ice nozzle 130 may be enabled. When a preset amount of ice cube is dispensed, or the contact between the contact protrusion 163 and the third detection member 173*c* is released, the control unit 50 stops the supply of the ice cube.

The manipulation member 160 may not be manipulated only once for dispensing the water, the crushed ice, and the ice cube. That is, the manipulation of the manipulation member 160 may be converted into the other mode while one of the manipulation for dispensing the water, the crushed ice, and the ice cube is performed.

For example, when the manipulation member 160 is further pushed in the state where the manipulation member 160 is pushed to dispense the water, the ice may be successively dispensed. On the other hand, when the manipulation member 160 moves forward in the state where the ice is dispensed, the water may be successively dispensed.

According to a third implementation, a difference of a pressure applied to a detection member when a manipulation member is manipulated can be detected to select dispensing of water or ice.

The third implementation is equal to the foregoing implementation except for an additional structure corresponding to a detection member. Thus, the same part will be designated by the same reference numeral, and detailed descriptions thereof will be omitted.

Figure 17:
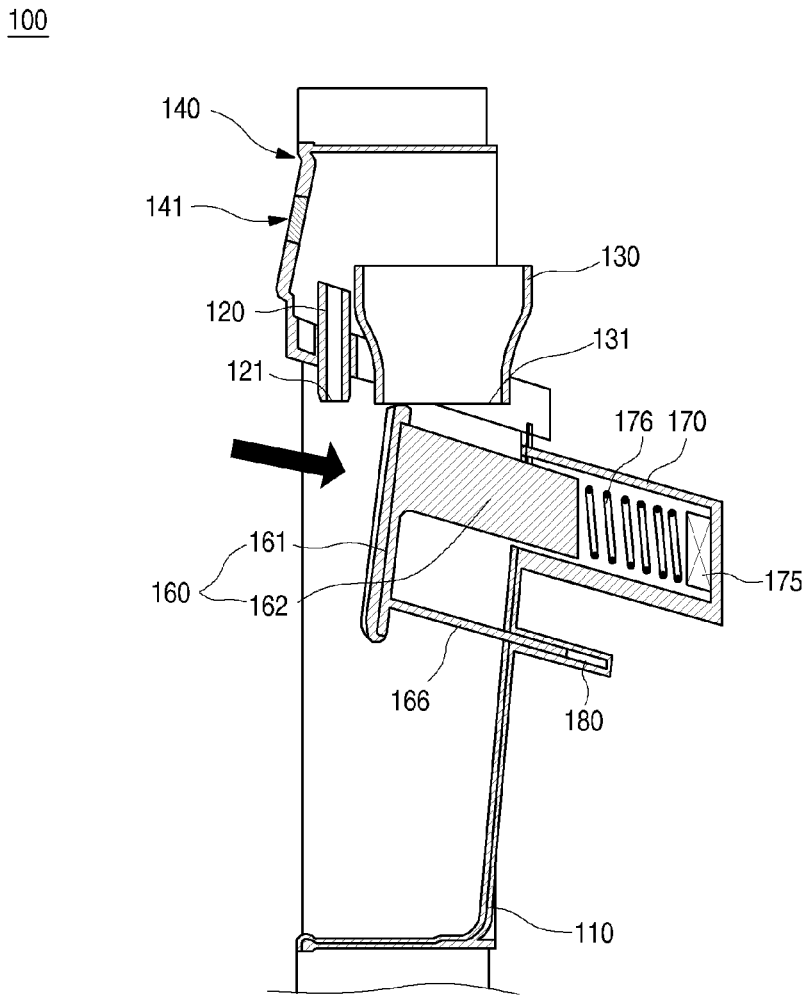
FIG. 17 is a cross-sectional view showing an example dispenser according to a third implementation.

FIG. 17 shows a dispenser according to the third implementation.

Referring to FIG. 17, a dispenser 100 according to the third implementation is disposed in a front surface of the door 21 to form a space recessed by a dispenser case 110.

A water nozzle 120 and an ice nozzle 130 which extend downward are disposed on the dispenser case 110. The water nozzle 120 and the ice nozzle 130 may be arranged forward and backward in a line.

Also, a cover 140 is disposed on an upper portion of the dispenser case 110 to cover front sides of the water nozzle 120 and the ice nozzle 130. Also, a display unit 141 for displaying selected states of the water nozzle 120 and the ice nozzle 130 and elapsing of a preset time may be disposed on the cover 140. Also, a main display unit 150 for displaying an operation state of a refrigerator 1 may be further disposed on a side of the dispenser case 110.

The manipulation member 160 includes a manipulation part 161 that contacts a container 2 and an extension part 162 extending from the manipulation part 161. Also, the extension part 162 is inserted into an extension part guide 170 that is opened from a rear wall of the dispenser case 110.

A detection member 175 for detecting a manipulation pressure of the manipulation member 160 is disposed inside the extension part guide 170. An elastic member 176 may be disposed between the extension part 162 and the detection member 175. A pressure sensor may be used as the detection member 175. The detection member 175 may detect a variation of a pressure due to the movement of the extension part 162.

In some cases, the elastic member 176 may be omitted, and the detection member 175 may directly contact the extension part 162 to detect the manipulation pressure of the manipulation member 160.

When the manipulation member 160 is pushed, the extension part 162 may move backward to press the elastic member 176. As a result, the detection member 175 may be pressed. The detection member 175 is connected to a control unit 50. The control unit 50 may distinguish the pressure detected by the detection member 175 in stages. Here, a water dispensing mode may be selected at a pressure in a preset first section, a crushed ice dispensing mode may be selected at a pressure in a second section, and an ice cube dispensing mode may be selected at a pressure in a third section.

Also, the pressure section of the detection member 175 may include a point at which a manipulation part 161 of at least the manipulation member 160 passes through the water nozzle 120 or the ice nozzle 130 so that water or ice is stably received into the container 2.

Also, in the state where the manipulation member 160 is manipulated to select the dispensing mode, the manipulated state of the manipulation member 160 may be maintained for a preset period. Then, after the preset time elapses, the selected water or ice may be dispensed.

A guide 166 extending backward may be further disposed under the extension part 162. The guide 166 is spaced apart from the extension part 162 and disposed under the extension part 162. When a guide hole 180 defined in the dispenser case 110 is inserted to push the manipulation member 160, the guide 166 may be inserted into the guide hole 180.

Thus, the manipulation member 160 may be stably pushed without moving when the manipulation member 160 is pushed. Thus, the manipulation of the user may be more improved.

According to a fourth implementation, a distance of the manipulation member that moves when a manipulation member is manipulated can be detected by a detection member to select dispensing of water or ice.

The fourth implementation is equal to the foregoing implementation except for addition of a structure of a detection member. Thus, the same part will be designated by the same reference numeral, and detailed descriptions thereof will be omitted.

Figure 18:
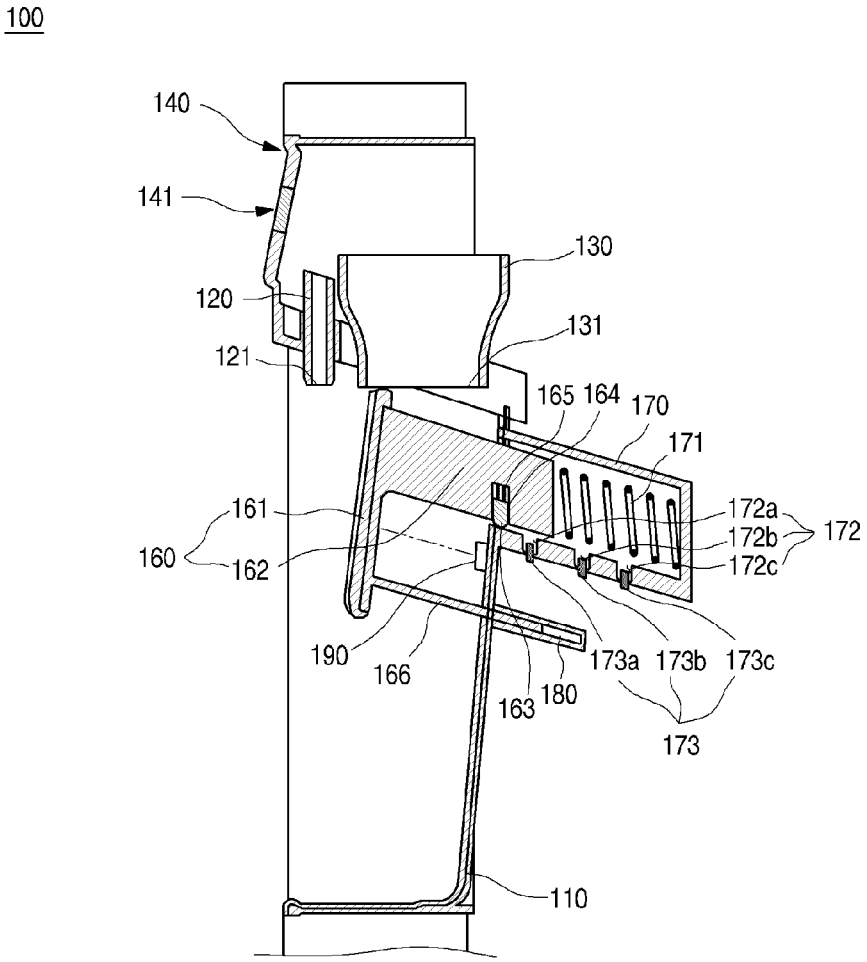
FIG. 18 is a cross-sectional view showing an example dispenser according to a fourth implementation.

FIG. 18 shows a dispenser according to a fourth implementation.

Referring to FIG. 18, a dispenser 100 according to the fourth implementation is disposed in a front surface of the door 21 to form a space recessed by a dispenser case 110.

A water nozzle 120 and an ice nozzle 130 which extend downward are disposed on the dispenser case 110. The water nozzle 120 and the ice nozzle 130 may be arranged forward and backward in a line.

Also, a cover 140 is disposed on an upper portion of the dispenser case 110 to cover front sides of the water nozzle 120 and the ice nozzle 130. Also, a display unit 141 for displaying selected states of the water nozzle 120 and the ice nozzle 130 and elapsing of a preset time may be disposed on the cover 140. Also, a main display unit 150 for displaying an operation state of a refrigerator 1 may be further disposed on a side of the dispenser case 110.

The manipulation member 160 includes a manipulation part 161 that contacts a container 2 and an extension part 162 extending from the manipulation part 161. Also, the extension part 162 is inserted into an extension part guide 170 that is opened from a rear wall of the dispenser case 110. An elastic member 171 is disposed inside the extension part guide 170. The elastic member 171 is configured to be pressed when the manipulation part 161 is pushed.

Also, a contact protrusion 163 protruding laterally is disposed outside the extension part 162. A plurality of recess parts 172 are defined along a moving direction of the extension part 162 inside the extension part guide 170. The recess parts 182 may be configured to allow the contact protrusion 163 to be accommodated when the manipulation member 160 is manipulated in stages.

A detection member 190 is disposed on a rear wall of the dispenser case 110. A distance sensor or proximity sensor for detecting a moving distance of the manipulation member 160 may be used as the detection member 190.

The detection member 190 is disposed at a rear side of the manipulation part 161. When the manipulation member is pushed, the detection member 190 detects a distance from the manipulation part 161 to detect the selection of the water, the crushed ice, or the ice cube.

Here, the detection member 190 may be set in consideration of a distance spaced apart from the recess part 172 and outlets 121 and 131 of the water nozzle 120 and the ice nozzle 130. When the selection of the water, the crushed ice, or the ice cube is selected, a selection signal may be transmitted to the control unit 50.

That is, when the manipulation member 160 is pushed, the extension part 162 may move backward to press the elastic member 171. Here, the contact protrusion 163 may be accommodated first into the first recess part 172*a*, and the detection member 190 may recognize a distance spaced apart from the manipulation part 161 to select a water dispensing mode.

Also, when the manipulation member 160 is further pushed than the pushed distance in case of the water dispensing mode, the contact protrusion 163 may be accommodated into the second recess part 172*b*. Here, the detection member 190 may recognize a distance spaced apart from the manipulation part 161 to select a crushed ice dispensing mode.

Also, when the manipulation member 160 is fully pushed, the contact protrusion 163 may be accommodated into the third recess part 172*c*. Here, the detection member 190 may recognize a distance spaced apart from the manipulation part 161 to select an ice cube dispensing mode.

Also, in the state where the manipulation member 160 is manipulated to select the dispensing mode, the selected mode may be displayed on the display unit 141. Then, the manipulated state of the manipulation member 160 may be maintained for a preset time, and then, after the preset time elapses, the elapsing of the preset time may be displayed on the display unit 141, and the selected water or ice may be dispensed.

A guide 166 extending backward may be further disposed on a lower portion of the extension part 162. The guide 166 is spaced apart from the extension part 162 and disposed under the extension part 162. When a guide hole 180 defined in the dispenser case 110 is inserted to push the manipulation member 160, the guide 166 may be inserted into the guide hole 180.

Thus, the manipulation member 160 may be stably pushed without moving when the manipulation member 160 is pushed. Thus, the manipulation of the user may be more improved.

According to a fifth implementation, an end of a manipulation member can be rotatably mounted on a dispenser case.

The fifth implementation is equal to the foregoing implementation except for a structure of the manipulation member. Thus, the same part will be designated by the same reference numeral, and detailed descriptions thereof will be omitted.

Figure 19:
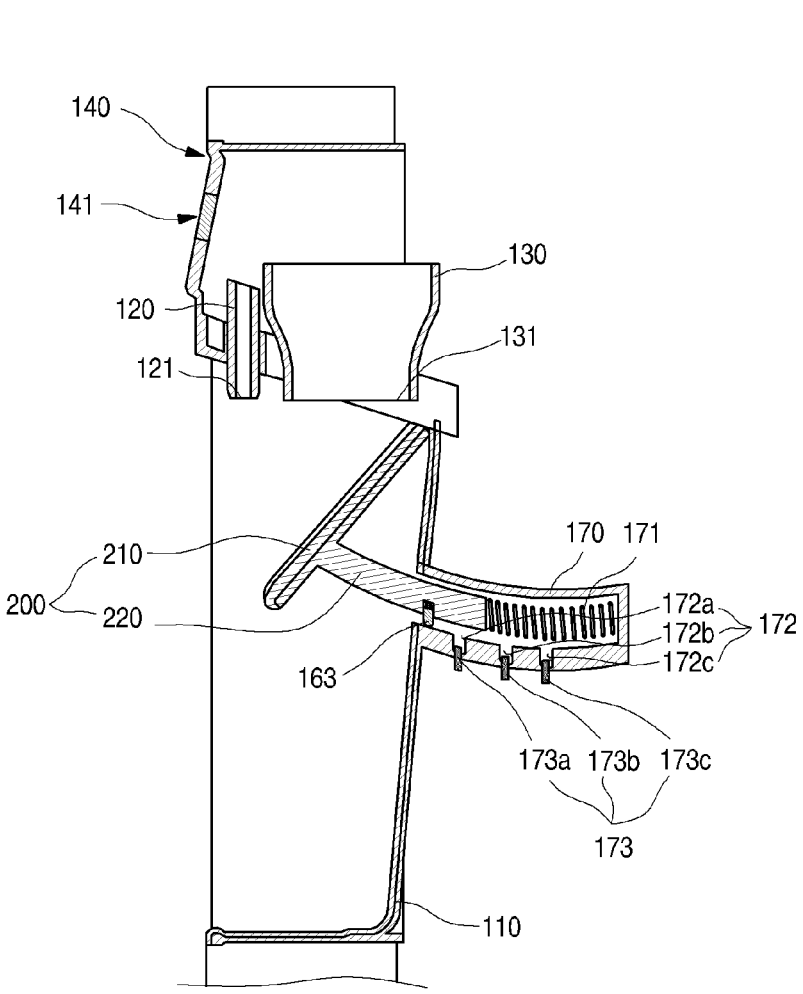
FIG. 19 is a cross-sectional view showing an example dispenser according to a fifth implementation.

FIG. 19 shows a dispenser according to a fifth implementation.

Referring to FIG. 19, a dispenser 100 according to the fifth implementation is disposed in a front surface of the door 21 to form a space recessed by a dispenser case 110.

A water nozzle 120 and an ice nozzle 130 which extend downward are disposed on the dispenser case 110. The water nozzle 120 and the ice nozzle 130 may be arranged forward and backward in a line.

Also, a cover 140 is disposed on an upper portion of the dispenser case 110 to cover front sides of the water nozzle 120 and the ice nozzle 130. Also, a display unit 141 for displaying selected states of the water nozzle 120 and the ice nozzle 130 and elapsing of a preset time may be disposed on the cover 140. Also, a main display unit 150 for displaying an operation state of a refrigerator 1 may be further disposed on a side of the dispenser case 110.

The manipulation member 200 includes a manipulation part 210 that contacts a container 2 and an extension part 220 extending from the manipulation part 210. An upper end of the manipulation part 210 may be shaft-coupled to the dispenser case 110 so that the manipulation member 200 is rotatable.

Also, the extension part 220 is inserted into an extension part guide 170 that is opened from a rear wall of the dispenser case 110. Also, the extension part 220 may have a predetermined curvature so that the extension part 220 is inserted into the extension part guide 170 when the manipulation member 200 rotates. Thus, the extension part guide 170 may also have a curvature corresponding to that of the extension part 220.

An elastic member 171 may be disposed on the extension part guide 170 to support the extension part 220. When the manipulation member 200 is pushed, a rear end of the extension part 220 may press the elastic member 174. Also, when the manipulation of the manipulation member 200 is released, the manipulation member 200 may return to its original position by a restoring force of the elastic member 171.

Also, a contact protrusion 163 protruding laterally is disposed on the extension part 220. A plurality of recess parts 172 are defined in the extension part guide 170 so that the contact protrusion 163 is accommodated in stages when the manipulation member 200 is pushed. Also, a detection member 173 is disposed on each of the plurality of recess parts 172. When contact with the contact protrusion 221 is detected, a selection signal may be transmitted to a control unit 50.

The number of recess part 172 and detection member 173 may be determined according to a manipulation process of the manipulation member 200. In the fifth implementation, each of a first recess part 172*a* and a first detection member 173*a*, a second recess part 172*b* and a second detection member 173*b*, and a third recess part 172*c* and a third detection member 173*c* may be provided to select water dispensing, crushed ice dispensing, and ice cube dispensing.

Thus, the user may push the manipulation member 200 to allow the manipulation member 200 to rotate. When the contact protrusion 221 is accommodated into the first recess part 172*a* to turn the first detection member 173*a* on, the water dispensing mode may be selected. When the contact protrusion 221 is accommodated into the second recess part 172*b* to turn the second detection member 173*b* on, the crushed ice dispensing mode may be selected. When the contact protrusion 221 is accommodated into the third recess part 172*c* to turn the third detection member 173*c* on, the ice cube dispensing mode may be selected.

As described above, a pushing degree of the manipulation member 200 may be adjusted to determine the dispensing of water or ice. Also, when a preset time is maintained in the state where the manipulation member 200 is manipulated to select the dispensing mode, desired water or ice may be dispensed from the water nozzle 120 or the ice nozzle 130.

According to a sixth implementation, a touch-type detection member may be provided to a manipulation member to select a dispensing mode according to the manipulated number of detection member.

The sixth implementation is equal to the foregoing implementation except for structures of the manipulation member and a detection member. Thus, the same part will be designated by the same reference numeral, and detailed descriptions thereof will be omitted.

Figure 20:
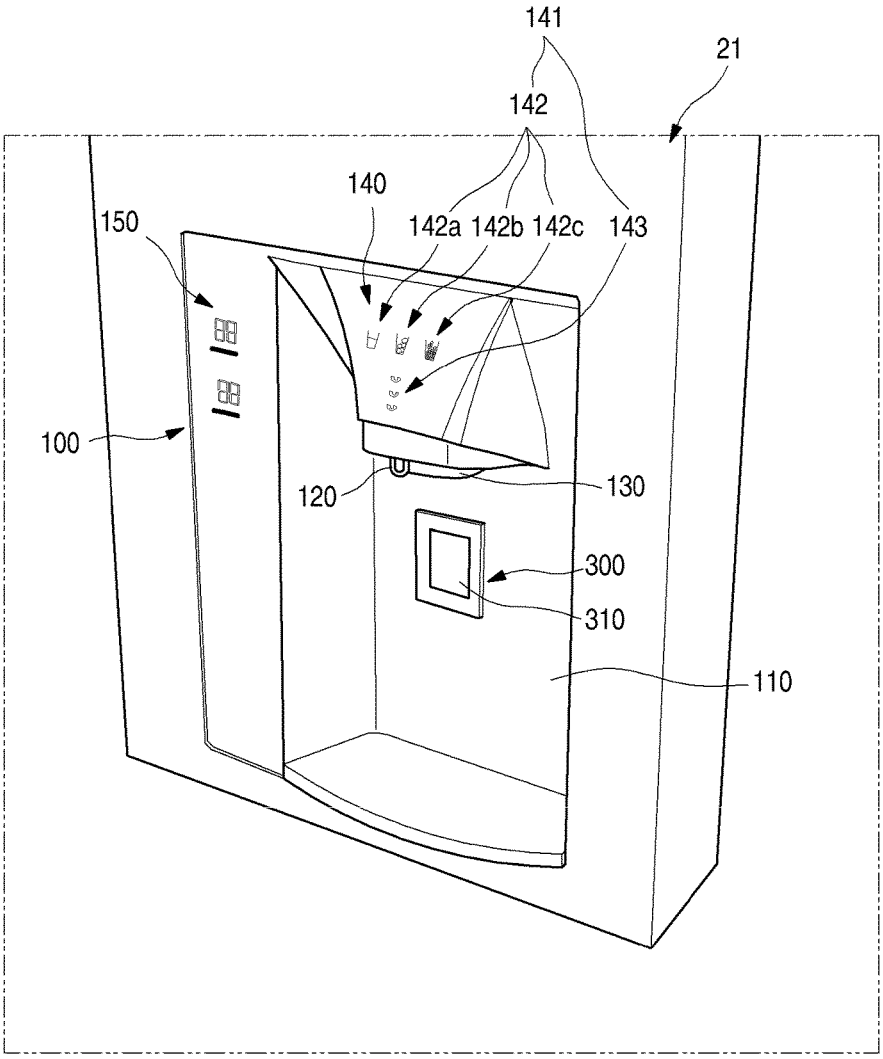
FIG. 20 is a perspective view showing an example dispenser according to a sixth implementation.

FIG. 20 shows a dispenser according to a sixth implementation.

Referring to FIG. 20, a dispenser 100 according to the sixth implementation is disposed in a front surface of the door 21 to form a space recessed by a dispenser case 110.

A water nozzle 120 and an ice nozzle 130 which extend downward are disposed on the dispenser case 110. The water nozzle 120 and the ice nozzle 130 may be arranged forward and backward in a line.

Also, a cover 140 is disposed on an upper portion of the dispenser case 110 to cover front sides of the water nozzle 120 and the ice nozzle 130. Also, a display unit 141 for displaying selected states of the water nozzle 120 and the ice nozzle 130 and elapsing of a preset time may be disposed on the cover 140. Also, a main display unit 150 for displaying an operation state of a refrigerator 1 may be further disposed on a side of the dispenser case 110.

The manipulation member 160 is disposed on a rear wall of the dispenser case 110, and a detection member 173 is disposed on the manipulation member 160. A touch sensor may be provided as the detection member 173. Here, when a user contacts or lightly taps the container 2 in a state where the user grasps the container 2, the detection member 173 may recognize the contact or tapping of the container 2.

Also, the detection member 173 may be integrated with the manipulation member 160. Thus, the dispensing mode of the water or ice may be selected according to a detected value inputted by the detection member 173 without substantial movement of the manipulation member 160.

In detail, the detection member 173 may detect a contact time or the number of taps to select the dispensing of the water, the crushed ice, and the ice cube in stages.

Thus, when the container 2 is in contact with the detection member 173 of the manipulation member 160 for a specific time or taps the detection member 173 a specific number of times, the state of the water or ice to be dispensed may be determined.

As described above, the contact time or tapping number of the detection member 173 may be adjusted to determine the dispensing of the water or ice. Also, when the preset time is maintained in the state where the detection member 173 is manipulated to select the dispensing mode without separately additional manipulation, desired water or ice may be dispensed from the water nozzle 120 or the ice nozzle 130.

According to the refrigerator and the method for controlling the same, the manipulation member used for dispensing the water or ice may be manipulated once by the user to select and dispense the water or ice.

Particularly, since the selection conversion and dispensing of the water or ice are enabled by only the movement of the manipulation member for converting the manipulated process even though the water or ice is being dispensed, the manipulation for dispensing the water or ice may be performed by using one member and through one operation.

Thus, the user may simply manipulate the manipulation member to select and dispense the water or ice, thereby improving the user's convenience. Also, in the case of the dispensing of the ice, since the manipulation process of the manipulation member is divided into the processes for dispensing the crushed ice and the ice cube, the one manipulation member may be manipulated in the single direction to dispense three phases such as the water, the ice cube, and the crushed ice, thereby significantly improving the user's convenience.

Also, since the number of process for dispensing the water or ice is minimized, the manufacturing costs may be reduced, and the productivity may be improved. Furthermore, since the number of button and lever that are exposed to the outside of the dispenser is minimized, an outer appearance of the refrigerator may be more elegant and simplified.

Also, the water or ice may be dispensed when the preset time elapses after the water or ice is selected to prevent malfunction due to the user from occurring. In addition, the selected state or the elapsing state of the preset time may be displayed to prevent the malfunction due to the user from occurring and to easily convert the selected state during the use.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body;

a storage space defined within the main body;

a door configured to open and close at least a portion of the storage space;

a dispenser provided in the door;

a water nozzle disposed on the dispenser and configured to dispense water;

an ice nozzle disposed on the dispenser and configured to dispense ice;

a single manipulation member disposed under the water nozzle and the ice nozzle, the manipulation member being configured to be continuously moved in a single direction in stages to thereby manipulate selecting and dispensing, one at a time, of the water and ice;

a water detection member and an ice detection member that are disposed inside the dispenser along a moving path of the manipulation member, the water detection member and the ice detection member each being configured to recognize manipulation of the manipulation member;

a control unit configured to control a valve and motor to thereby dispense the water or ice according to an input of the water detection member and the ice detection member; and a display unit disposed on the dispenser and configured to display the selected state of the water or ice according to the manipulation of the manipulation member, wherein the manipulation member comprises:

a manipulation part configured to be pushed by a cup or a hand of a user, and an extension part that extends from the manipulation part and is configured to be inserted into a case of the dispenser, and wherein the ice detection member comprises a crushed ice detection member and a cube ice detection member, the crushed ice detection member and the cube ice detection member being spaced apart from each other and arranged along the same line as the water detection member.

2. The refrigerator according to claim 1, wherein the water detection member and the ice detection member are provided as switches that are arranged along a moving path of the extension part and spaced apart from each other by a predetermined distance, the water detection member and the ice detection member being configured to be successively contacted by the extension part.

3. The refrigerator according to claim 1, wherein the water detection member and the ice detection member are configured and arranged to contact one side of the extension part based on the manipulation part passing under an outlet of the water nozzle and an outlet of the ice nozzle.

4. The refrigerator according to claim 1, wherein a shape of the extension part and a shape of a side of the dispenser in which the extension part is accommodated match each other, and the dispenser comprises:

a plurality of recess parts configured to guide a multi-stage movement of the manipulation member, and a contact protrusion selectively accommodated into each of the plurality of recess parts.

5. The refrigerator according to claim 1, wherein the dispenser comprises:

a plurality of recess parts in which each of the water detection member and the ice detection member are respectively accommodated, the plurality of recess parts being located at positions corresponding to positions of the manipulation member for which the water and ice are correspondingly selected; and a contact protrusion protruding from the extension part, the contact protrusion being configured to be received by each of the plurality of recess parts according to the movement of the manipulation member.

6. The refrigerator according to claim 1, wherein the water detection member is disposed at a front side of the ice detection member.

7. The refrigerator according to claim 1, wherein the cube ice detection member is disposed at a rear side of the crushed ice detection member.

8. The refrigerator according to claim 1, wherein a first distance between the water detection member and the crushed ice detection member is greater than a second distance between the crushed ice detection member and the cube ice detection member.

9. The refrigerator according to claim 1, wherein the extension part is supported by an elastic member, the elastic member being configured to, based on the manipulation member being manipulated, apply a force to the extension part to return the manipulation member to an original position of the manipulation member.

10. The refrigerator according to claim 1, wherein the control unit is configured to control the valve and motor so that the valve and motor are driven based on a preset time elapsing after the selection of the manipulation member is detected.

11. The refrigerator according to claim 10, wherein the display unit is configured to display an elapsing state of the preset time based on the dispensing of the water or ice being selected according to a manipulated state of the manipulation member.

12. The refrigerator according to claim 1, wherein one of the manipulation member or the water nozzle includes a stopper that is configured to make contact with the other of the manipulation member or the water nozzle to thereby restrict a movement of the manipulation member.

13. The refrigerator according to claim 12, wherein the stopper is formed of a rubber or a synthetic resin material, and the stopper is disposed on a side of the manipulation member that faces the water nozzle and configured to correspond to a circumferential or contact position of the water nozzle.

14. A refrigerator comprising:

a main body;

a storage space defined within the main body;

a door configured to open and close at least a portion of the storage space;

a dispenser provided in the door;

a water nozzle disposed on the dispenser and configured to dispense water;

an ice nozzle disposed on the dispenser and configured to dispense ice;

a single manipulation member disposed under the water nozzle and the ice nozzle, the manipulation member being configured to be continuously moved in a single direction in stages to thereby manipulate selecting and dispensing, one at a time, of the water and ice;

a water detection member and an ice detection member that are disposed inside the dispenser along a moving path of the manipulation member, the water detection member and the ice detection member each being configured to recognize manipulation of the manipulation member;

a control unit configured to control a valve and motor to thereby dispense the water or ice according to an input of the water detection member and the ice detection member; and a display unit disposed on the dispenser and configured to display the selected state of the water or ice according to the manipulation of the manipulation member, wherein the manipulation member comprises:

a manipulation part configured to be pushed by a cup or a hand of a user, and an extension part that extends from the manipulation part and is configured to be inserted into a case of the dispenser, wherein one of the manipulation member or the water nozzle includes a stopper that is configured to make contact with the other of the manipulation member or the water nozzle to thereby restrict a movement of the manipulation member, and wherein the stopper is formed of a rubber or a synthetic resin material, and the stopper is disposed on a side of the manipulation member that faces the water nozzle and configured to correspond to a circumferential or contact position of the water nozzle.

15. The refrigerator according to claim 14, wherein the water detection member and the ice detection member are provided as switches that are arranged along a moving path of the extension part and spaced apart from each other by a predetermined distance, the water detection member and the ice detection member being configured to be successively contacted by the extension part.

16. The refrigerator according to claim 14, wherein the water detection member and the ice detection member are configured and arranged to contact one side of the extension part based on the manipulation part passing under an outlet of the water nozzle and an outlet of the ice nozzle.

17. The refrigerator according to claim 14, wherein a shape of the extension part and a shape of a side of the dispenser in which the extension part is accommodated match each other, and the dispenser comprises:

a plurality of recess parts configured to guide a multistage movement of the manipulation member, and a contact protrusion selectively accommodated into each of the plurality of recess parts.

18. The refrigerator according to claim 14, wherein the dispenser comprises:

a plurality of recess parts in which each of the water detection member and the ice detection member are respectively accommodated, the plurality of recess parts being located at positions corresponding to positions of the manipulation member for which the water and ice are correspondingly selected; and a contact protrusion protruding from the extension part, the contact protrusion being configured to be received by each of the plurality of recess parts according to the movement of the manipulation member.

19. The refrigerator according to claim 14, wherein the water detection member is disposed at a front side of the ice detection member.

20. The refrigerator according to claim 14, wherein the extension part is supported by an elastic member, the elastic member being configured to, based on the manipulation member being manipulated, apply a force to the extension part to return the manipulation member to an original position of the manipulation member.

21. The refrigerator according to claim 14, wherein the control unit is configured to control the valve and motor so that the valve and motor are driven based on a preset time elapsing after the selection of the manipulation member is detected.

22. The refrigerator according to claim 21, wherein the display unit is configured to display an elapsing state of the preset time based on the dispensing of the water or ice being selected according to a manipulated state of the manipulation member.

* * * * *